US008694297B2

(12) United States Patent
Ding et al.

(10) Patent No.: US 8,694,297 B2
(45) Date of Patent: Apr. 8, 2014

(54) POROUS MEDIUM EXPLOITATION METHOD USING FLUID FLOW MODELLING

(75) Inventors: Didier Yu Ding, Le Pecq (FR); Gérard Renard, Rueil Malmaison (FR)

(73) Assignee: IFP, Rueil-Malmaison Cedex (FR)

( * ) Notice: Subject to any disclaimer, the term of this patent is extended or adjusted under 35 U.S.C. 154(b) by 533 days.

(21) Appl. No.: 12/767,866

(22) Filed: Apr. 27, 2010

(65) Prior Publication Data

US 2010/0299125 A1 Nov. 25, 2010

(30) Foreign Application Priority Data

May 20, 2009 (FR) ..... 09 02533

(51) Int. Cl.
*G06G 7/50* (2006.01)
*G06G 7/48* (2006.01)

(52) U.S. Cl.
USPC ..... 703/9; 703/10

(58) Field of Classification Search
USPC ..... 703/10, 9
See application file for complete search history.

(56) References Cited

U.S. PATENT DOCUMENTS

| | | | | |
|---|---|---|---|---|
| 2001/0006387 | A1* | 7/2001 | Bennis et al. | 345/418 |
| 2006/0277013 | A1 | 12/2006 | Bennis et al. | |
| 2008/0319726 | A1 | 12/2008 | Berge et al. | |
| 2009/0012765 | A1* | 1/2009 | Raphael | 703/10 |
| 2009/0198477 | A1* | 8/2009 | Benish et al. | 703/10 |
| 2010/0082142 | A1* | 4/2010 | Usadi et al. | 700/104 |
| 2011/0226471 | A1* | 9/2011 | Wattenbarger et al. | 166/263 |

FOREIGN PATENT DOCUMENTS

EP 1 729 153 A1 6/2006

OTHER PUBLICATIONS

Mlacnik, M.J. et al: "Using Well Windows in Full Field Reservoir Simulatio Symposium," Houston, Texas, U.S.A., Feb. 2001, SPE 66371 (XP007911024), pp. 1-8.

Boe, O, et al: "On Near-Wellbore Modeling and Real-Time Reservoir Management," SPE 66369, Houston, Teas, USA Feb. 1-14, 2001, pp. 1-14.

Flandrin, N., et al: "3D Hybrid Mesh Generation for Reservoir Simulation," EMCOR Cannes, France, Aug. 30-Sep. 2, 2004., pp. 108.

Ding, Y., et al: "Evaluation of Horizontal Well Performance After Drilling Induced Formation Damage", J. of Energy Resources Technology, vol. 127, Sep. 2005., pp. 1-13.

(Continued)

*Primary Examiner* — David Silver
(74) *Attorney, Agent, or Firm* — Antonelli, Terry, Stout & Kraus, LLP.

(57) ABSTRACT

A porous medium exploitation method having application to petroleum exploitation is disclosed using coupling between a reservoir model and a near-wellbore model for modelling fluid flows. Fluid flows within the medium are simulated using a reservoir simulator and a near-wellbore simulator. At each time step, the boundary conditions used by the second simulator are calculated by means of with the reservoir simulator. Numerical productivity indices used by the reservoir simulator are calculated by means of using the near-wellbore simulator. The fluid flows within the porous medium during a given period of time are modelled by repeating the previous stages for several time steps. An optimum medium exploitation scenario is deduced determined from this modelling by taking into accounting for, for example, a well damage due to a drilling fluid, an injection of a polymer solution or of an acid solution in the well.

27 Claims, 15 Drawing Sheets

(56) References Cited

OTHER PUBLICATIONS

Johansen et al: "Iterative Techniques in Modeling of Multi-phase Flow in Advanced Wells and the Near Well Region", Journal of Petroleum Science and Engineering, Elsevier, Amsterdam, NL, vol. 58, No. 1-2, Jul. 24, 2007, pp. 49-67, XP022166386, ISSN: 0920-4105.

Chen, Yuguang, et al: "Upscaled Modeling of Well Singularity for Simulating Flow in Heterogeneous Formations," Computational Geosciences, Kluwer Academic Publishers, DO, vol. 12, No. 1, Jan. 4, 2008, pp. 29-45, XP019571351, ISSN: 1573-1499.

Boe, O, et al: "On Near Wellbore Modeling and Real Time Reservoir Management", SPE Reservoir Simulation Symposium, SPE, US, No. SPE 66369, Feb. 11, 2001, pp. 1-14, XP007911025.

Mlacnik, M.J., et al: "Using Well Windows in Full Field Reservoir Simulation", SPE Reservoir Simulation Symposium, SPE, US, No. WPE 66371, Feb. 11, 2001, pp. 1-8, XP007911024.

Database Compendex Engineering Information, Inc., New York, NY, US, Feb. 28, 2007, Krogstad, S., et al: "Multiscale Mixed-Finite-Element Modeling of Coupled Wellbore/Near-Well Flow", XP002561634.

Database Compendex Engineering Information, Inc., New York, NY, US; Jun. 14, 2007, Phillips, P.D., et al: "Identifying Reservoir Potential in Shale-Dominated Thinly Bedded Clastic Reservoirs with a Near-Well-Bore Modeling Apoproach", XP002561635.

* cited by examiner

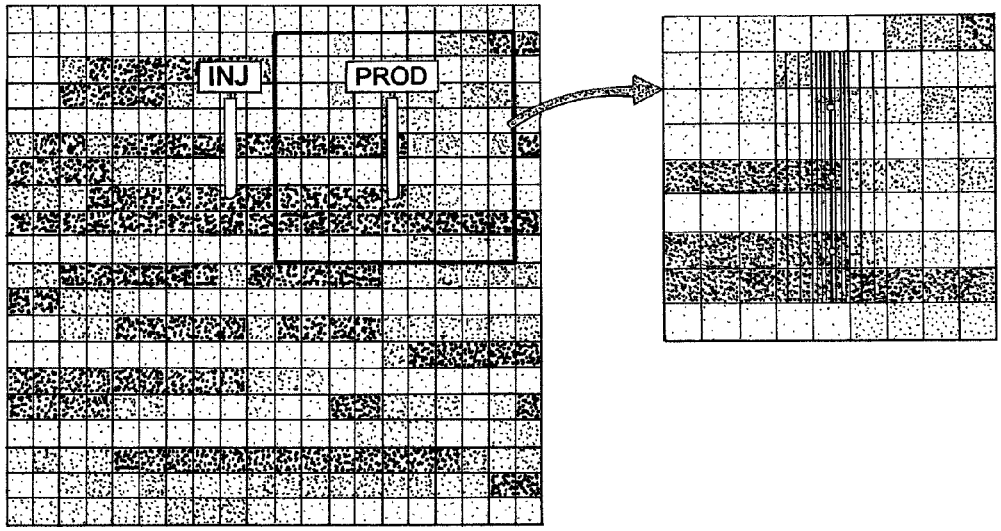
Fig. 14A
Fig. 14B
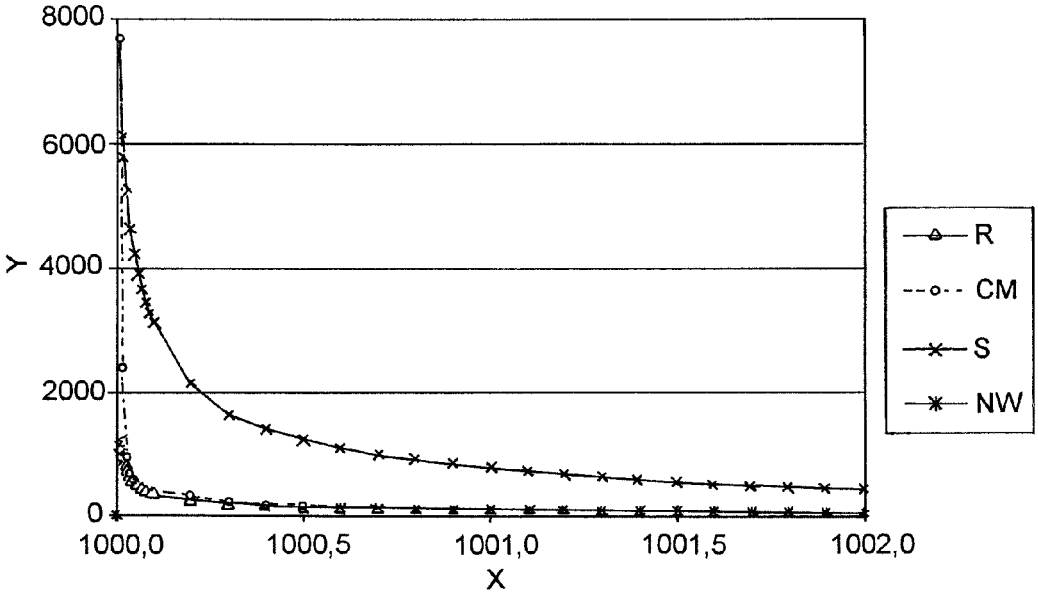
Fig. 15

POROUS MEDIUM EXPLOITATION METHOD USING FLUID FLOW MODELLING

BACKGROUND OF THE INVENTION

1. Field of the Invention

The present invention relates to underground media exploitation.

2. Description of the Prior Art

Local phenomena that may occur near a well, such as damage, have a tremendous impact on the injectivity or the productivity of a well. In the petroleum industry, it is very important to predict injectivity or productivity, especially when there are formation alterations in the vicinity of wells, which change the injection or production capacity of the well.

Great efforts have been made for a long time by use of experimental techniques, in the laboratory, or numerical modelling methods, in order to take into account these local phenomena near wells, as well as their impact on injectivity or productivity.

Numerical methods for modelling fluid flows within a well (injectivity and productivity of a well) comprise constructing two distinct models: the reservoir model and the near-wellbore model.

A reservoir model comprises two elements:

a grid, referred to as reservoir grid, having a set of cells that spatially discretize the reservoir and a flow simulator. The flow simulator is a software for modelling fluid flows within a porous medium within the reservoir grid. This software simulates dynamic data/properties of the fluids (water, oil, gas): pressure, flux (amount of matter crossing a surface), saturation, flow rates or concentrations. For example, a simulator allows estimation, for a given well exploitation scenario (production scenario or injection scenario) and for a given time interval water, oil and gas saturations and oil, gas and water flow rates, water cut (water fraction in the liquid production), GOR (gas and oil ratio in the production), concentrations in polymer absorbed on the rock of the porous medium and the polymer injection flow rates, if a polymer solution is injected into the reservoir by an injection well, etc.

A near-wellbore model comprises two elements:

a grid, referred to as a "near-wellbore grid," having a set of cells spatially discretizing the well and its surroundings. Its surroundings therefore belong to the porous medium in which the well is drilled; and a flow simulator simulating with the near-wellbore grid, dynamic data/properties of the fluids (water, oil, gas).

The reservoir model and the near-wellbore model are generally autonomous and decoupled. Local phenomena are generally limited to the immediate vicinity of the well (to distances measured from centimeters to meters). Very small cells are necessary for the near-wellbore grid whereas larger cells are used for reservoir grids to accelerate calculations.

There are known techniques which use a single reservoir flow simulator for these two grids. It is for example possible to use the technique referred to as a "hybrid grid" combining, within a single grid, cells for the reservoir grid and cells for a locally refined grid of the near-wellbore region. A single flow simulator is associated with this grid type so as to better account for the behaviors of flows in the vicinity of the well in a field simulation.

However, simultaneous flow simulations in the reservoir, which require a very large number of cells, and in the areas close to the well with smaller cells, which require small time steps to provide calculation stability, pose numerical calculation problems, in particular the problem of calculating time (CPU time).

Domain decomposition techniques, described for example by GAIFFE, S. "*Maillages Hybrides et Décomposition de Domaine pour la Modélisation des Réservoirs Pétroliers*", Ph.D. Thesis, Paris 6 University, 2000, and windowing techniques, described for example in the following document: MLACNIK, M. J. and HEINEMANN, Z. E. "*Using Well Windows in Full Field Reservoir Simulation*", paper SPE 66371 presented at the SPE Reservoir Simulation Symposium, Houston, Tex., U.S.A., February 2001, have thus been developed.

Some delicate points such as convergence, stability or calculating time however pose problems in industrial applications. Furthermore, the domain decomposition method is not always "conservative" (deterioration of the mass balance in the model as a function of time), which is not suitable for practical use of the method. Besides, all these techniques require reformulation of the mathematical equations and of the boundary conditions developed in the flow simulators and new developments are necessary to integrate the near and far well solutions in a single model, which is a long and difficult task.

SUMMARY OF THE INVENTION

The invention relates to a computer-implemented method for modelling fluid flows within a porous medium traversed by at least one well. The method comprises using a first flow simulator allowing simulation of the flow of fluids within the porous medium from numerical productivity indices relating fluid pressures to fluid flow rates and using a second flow simulator for simulating the flow of fluids in the near-wellbore region from boundary conditions. The method comprises the following stages:

a) simulating fluid flows within the medium using the first simulator over a predetermined time interval between times $T_0$ and $T_1$ and determining therefrom updated boundary conditions for the second simulator;

b) simulating fluid flows in the near-wellbore region using the second simulator over the same time interval, using the updated boundary conditions and determining therefrom numerical productivity indices updated for the first simulator; and c) modeling the fluid flows within the porous medium for a period of time between $T_0$ and $T_n$ where $T_n > T_1$, by repeating stages a) and b), for successive time intervals between $T_o$ and $T_n$.

The invention provides improvement of the injectivity and the productivity of wells drilled through a porous medium, such as a hydrocarbon reservoir or a geologic $CO_2$ storage reservoir.

According to the invention, each successive time interval can have a length that depends on the calculation time step of the first flow simulator and on a time step of the second flow simulator. For example, each successive time interval can have a length equal to a time step of the first flow simulator.

The boundary conditions can be determined by linear interpolation of the results of the first simulator between the start times and the end times of the successive time intervals. As for the numerical productivity indices, the indices can be determined by comparing flow rates calculated by the first simulator and flow rates calculated by the second simulator.

According to an embodiment, the fluid flows within the medium are simulated using the first simulator on a first grid discretizing the porous medium in a set of cells and the fluid flows in the near-wellbore region are simulated using the second simulator on a second grid discretizing the well and the near-wellbore region in a set of cells. The second grid is generated by constraining cells located on an edge of the second grid so that their interfaces coincide with the interfaces of the cells of the first grid.

In cases where multiphase flows are modelled, numerical productivity index multipliers are updated instead of the numerical productivity indices themselves, for each phase, by comparing flow rates per phase calculated by the first simulator and flow rates per phase calculated by the second simulator.

The invention also relates to a method of exploiting an underground porous reservoir using at least one well traversing the reservoir in which at least one fluid circulates between the reservoir and the well. According to this method, data relative to the geometry of the porous reservoir are acquired, from which a discretization of the reservoir into a set of cells, referred to as "reservoir grid," is constructed and a discretization of the well and of the near-wellbore region into a set of cells, referred to as "near-wellbore grid," is constructed. This method also comprises the following stages:

a) selecting a porous reservoir exploitation scenario;

b) associating with the reservoir grid a first flow simulator allowing simulation of the flow of fluids within the reservoir from at least the production scenario, input data relative to the fluid and to the reservoir, numerical productivity indices allowing relating of pressures to flow rates and boundary conditions;

c) associating with the near-wellbore grid a second flow simulator for simulating the flow of fluids in the near-wellbore region, from at least the following data: input data relative to the fluid and the reservoir and boundary conditions;

d) modeling the fluid flows within the porous medium and in the near-wellbore region; and e) modifying the exploitation scenario and repeating stage d) until an optimum exploitation scenario is obtained.

According to this exploitation method, well damage due to a drilling fluid can be accounted for by modelling invasion of the porous reservoir by the drilling fluid in stages d) and e).

The exploitation scenario can comprise an injection of a polymer solution into the well and the flows can then be modelled to prevent water inflow. The exploitation scenario can also comprise injection of an acid solution into the well and the flows can then be modelled to evaluate the impact of an acid stimulation.

BRIEF DESCRIPTION OF THE DRAWINGS

Other features and advantages of the method according to the invention will be clear from reading the description hereafter of embodiments given by way of non limitative examples, with reference to the accompanying figures wherein:

FIGS. 10A and 10B compare the drilling fluid invasion volume simulated by the coupling method with that of the reference solution wherein FIG. 10A shows the invasion flow rate during drilling the axis X is the time expressed in days, the axis Y is the flow rate expressed in $m^3$/day, curve R is the reference solution, and curve CM is the simulation with the coupling method, and wherein FIG. 10B shows the invasion volume as a function of time, the axis X is the time expressed in days, the axis Y is the flow rate in $m^3$/day, curve R is the reference solution, and curve CM is the simulation with the coupling method;

FIGS. 14A and 14B show the coupling grids wherein FIG. 14A is the grid of the reservoir model and FIG. 14B is the grid of the near-wellbore model;

FIG. 15 shows the polymer injection flow rate in the well treated wherein the axis X is the time in days, the axis Y is the flow rate in $m^3$/day, curve R is the reference solution, curve CM is the simulation of the reservoir model with the coupling method, curve S is the direct simulation with the reservoir model without coupling and curve NW is the simulation of the near-wellbore model with coupling;

FIGS. 16A to 16E show the polymer injection flow rate in the layers wherein FIG. 16A shows the polymer injection flow rate in layer 1, wherein FIG. 16B shows the polymer injection flow rate in layer 2, FIG. 16C shows the polymer injection flow rate in layer 3, FIG. 16D shows the polymer injection flow rate in layer 4. FIG. 16E shows the polymer injection flow rate in layer 5, the axis X is the time in days, the axis Y is the flow rate in $m^3$/day, curve R is the reference solution, curve CM is the simulation of the reservoir model with the coupling method, curve S is the direct simulation with the reservoir model without coupling, and curve NW is the simulation of the near-wellbore model with (of course) coupling;

FIG. 20C shows the reference solution in the vicinity of the well and FIG. 20D shows the water saturation in the vicinity of the well, simulated with the near-wellbore model;

FIGS. 21A to 21D show a pressure map after 1100 days wherein FIG. 21A shows the reference solution in the field, FIG. 21B shows the solution obtained with the coarse-grid reservoir model with coupling, FIG. 21C shows the reference solution in the vicinity of the well and FIG. 21D shows the solution with the near-wellbore model.

DETAILED DESCRIPTION

The invention relates to a method of exploiting an underground porous medium by injecting a fluid into the medium via at least one well and/or by producing a fluid present in the medium by also at least one well also. The method comprises modelling fluid flows in the system of the porous medium (reservoir and well surroundings). It therefore is in particular modelling of the injectivity or the productivity of wells traversing a porous medium.

Figure 1:
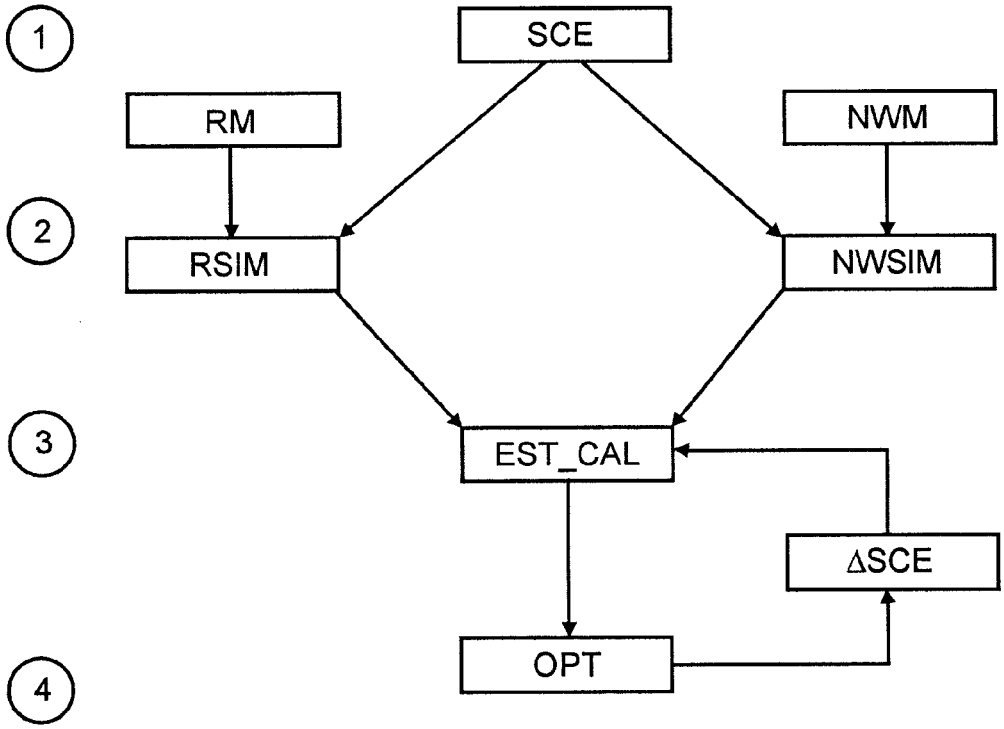
FIG. 1 illustrates the main stages of the method according to the invention.

FIG. 1 illustrates the main stages of the method:

1. selection of a porous medium exploitation scenario, a production scenario and/or an injection scenario (SCE);
2. selection of a flow simulator (RSIM) compatible with a given reservoir grid and selection of a flow simulator (NWSIM) compatible with a given near-wellbore grid;
3 by means of a coupling between the two simulators (EST_CAL and FIG. 2), estimation of the fluid flows, that is, for example, of the volume injected or of the volume produced, over a given time interval; and
4. determination of the optimum exploitation scenario through modification of the exploitation scenario and repetition of stage 3 (OPT).

1—Selection of a Porous Medium Exploitation Scenario

It can be a production scenario for producing the hydrocarbons contained in the porous medium (reservoir) or an injection scenario for injecting an acid gas such as $CO_2$ into an underground reservoir with a goal of acid gas storage. A scenario is described by the position of the wells, the recovery or injection method, the injection and/or production flow rates and times and the operating conditions in such wells, such as the bottomhole flow rate or pressure.

Within the context of production, the reservoir engineer selects a production method, waterflooding for example, whose optimum implementation scenario remains to be determined for the reservoir considered. Definition of an optimum scenario, for example, sets the number and the layout (position and spacing) of the injectors and of the producers in order to best take into account the impact of heterogeneities within the reservoir, for example permeability channels, fractures, etc., on the progression of the fluids in the reservoir. Depending on the scenario selected and on the geometrical representation of the reservoir, it is then possible to simulate the expected hydrocarbon production by means of the tool well known to specialists: a flow simulator.

Selection of a scenario, through the definition of multiple technical characteristics, is a stage that is well known.

2—Selection of the Flow Simulators

The type of grid on which the simulator is intended to work has to be known in order to select a flow simulator.

Construction of Reservoir (RM) and Near-Wellbore (NWM) Grids

Figure 3:
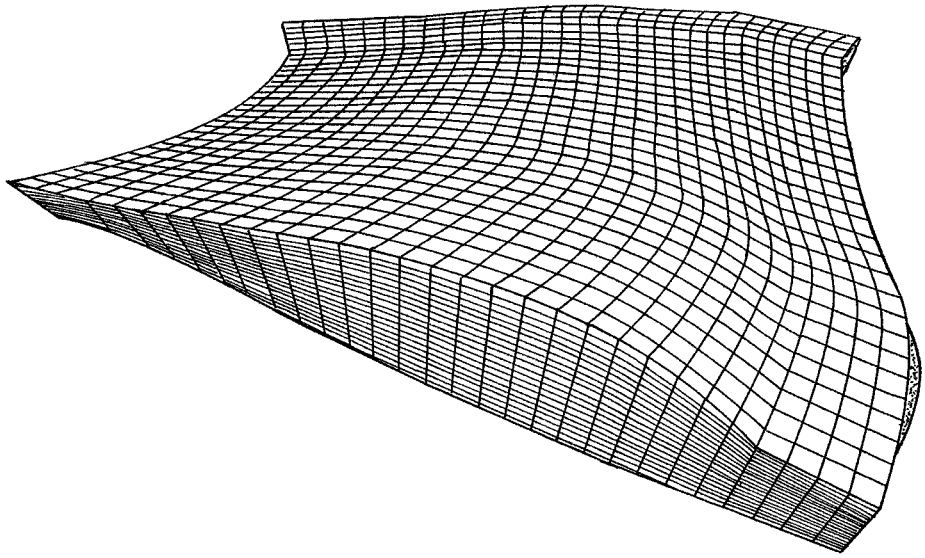
FIG. 3 shows the coarse grid used for field simulation in a reservoir model.

The "reservoir grid" has a set of cells spatially discretizing the reservoir (porous medium+well). An example of a reservoir grid is illustrated in FIG. 3, which is a coarse grid. Some cells correspond to the "porous medium" part and others correspond to the part where the well is drilled. The cells where the well is drilled are referred to as "well cells of the reservoir grid."

Figure 4:
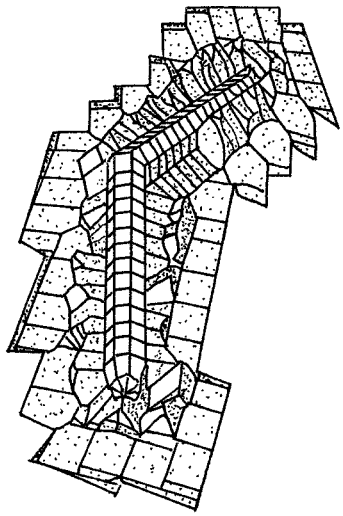
FIG. 4 shows the fine grid used for simulation of the detailed flow phenomena around the well in a near-wellbore model.

The "near-wellbore grid" has a set of cells spatially discretizing the well and its surroundings. An example of a near-wellbore grid is illustrated in FIG. 4. This grid is fine in order to simulate detailed phenomena around the well. Its surroundings thus belong to the porous medium in which the well is drilled. Some cells correspond to the "porous medium" part and others correspond to the "well" part. The latter are referred to as well cells of the near-wellbore grid.

The generation of the grids, whether the reservoir grid or the near-wellbore grid, is a well-known stage involving many known methods for construction. For example, near-wellbore grid construction techniques are described in the following document:

Boe, O., Flynn, J. and Reiso, E., "On Near-Wellbore Modeling and Real-Time Reservoir Management", SPE 66,369, Houston, Tex., USA, 11-14 Feb. 2001.

There are also known methods for constructing reservoir grids from data relative to the geometry of the medium (seismic data, logs . . . ), described for example in the following document:

Flandrin, N., Bennis, C. and Borouchaki, H., "3D Hybrid Mesh Generation for Reservoir Simulation", ECMOR, Cannes, France, 30 August-2 Sep. 2004.

Definition of Reservoir and Near-Wellbore Models

Definition of a reservoir model requires associating a flow simulator with the reservoir grid. Similarly, definition of a near-wellbore model requires associating a flow simulator with the near-wellbore grid.

As it is known to a person skilled in the art, in order to work, a flow simulator needs certain data referred to as input data:

Geometrical characteristics of the reservoir, characteristics of the rock, characteristics of the fluids in place and of the fluids injected (density, viscosity), relative permeability curves, capillary pressure curves, initial fluid saturations, etc.;

Boundary conditions of the simulated domain and the wells where fluids are injected or produced. The boundary conditions are the values of dynamic data such as pressure, flow rate or flux, fluid saturations, at the edges of the grid or in the cells that make up the edges of the reservoir or near-wellbore grid. An example of boundary conditions can be: a zero flux at all the edges of the grid, or saturations and pressures imposed on the cells at the edges of the grid;

Optionally numerical Productivity Indices (IP). The connection between the pressure in the cells crossed by a well and the pressures in the well itself is achieved by a numerical Productivity Index (IP). The numerical IP can be calculated with an analytical formula in the code or given by the user of the software (simulator). In general, the simulator calculates a numerical IP using an analytical formula at the start of the simulation. However, if the user gives a numerical IP in the input data set, it is the user's numerical IP that is taken into account in the simulation.

According to the invention, it is possible to use any type of flow simulator, whether for the reservoir model or for the near-wellbore model. In fact, one object of the invention relates to a coupling method allowing coupling, in a very simple manner, a reservoir model for simulation of the reservoir to a near-wellbore model, which is an autonomous model for simulating detailed phenomena around the well.

Regarding the reservoir model simulator, it can be implemented, for example, with Puma$^{Flow}$® software (IFP, France).

Regarding the near-wellbore model simulator, the simulator described in the following document can be used: DING, Y., RENARD, G.: "*Evaluation of Horizontal Well Performance after Drilling Induced Formation Damage*", J. of Energy Resources Technology, Vol. 127, September, 2005.

3—Estimation of the Volume of Fluid Displaced Over a Given Time Interval

The estimation can be by modelling the injectivity or the productivity of a well traversing the porous medium and allowing exploitation of this medium. This modelling is carried out over a given time interval $D=[T_0; T_n]$. For example, the behavior of the medium+well system over 20 years is modelled, considering the previously selected exploitation scenario.

The technique used here performs a coupling between the two flow simulators.

Figure 5:
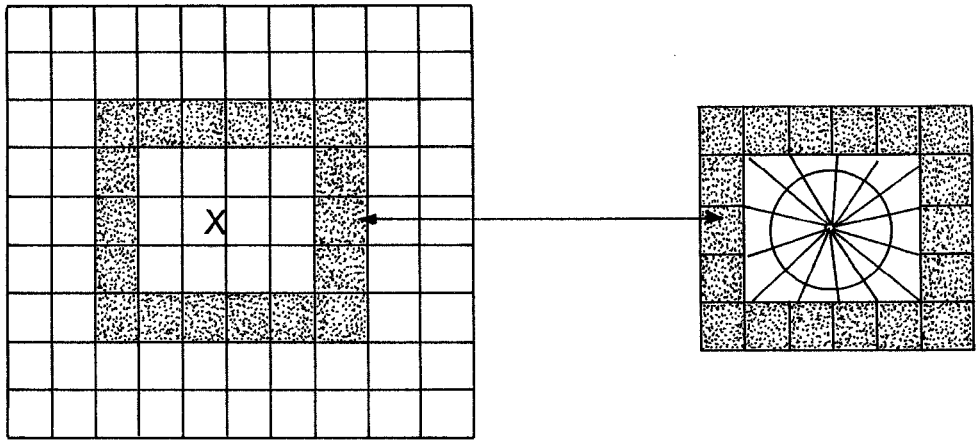
FIG. 5 shows the two grids used in the coupling wherein the figure on the left shows the reservoir grid for field simulation and the figure on the right shows the grid around the well in the near-wellbore model and the edge cells (grey) in the near-wellbore model coincide with the cells of same color in the reservoir grid.

A coarse grid is often used for the reservoir model and a fine grid is usually necessary to simulate the detailed phenomena around the well. FIG. 5 shows the two grids used in the coupling. The left-hand figure represents the reservoir grid for field simulation and the right-hand figure represents the grid in the vicinity of the well in the near-wellbore model. The edge cells (grey) in the near-wellbore model coincide with the cells of same color in the reservoir grid. The cross indicates the well location.

The time steps used in the near-wellbore model are generally much smaller than those of the reservoir model. The reservoir model is mainly used to simulate the flows in the reservoir in its entirety.

Time $T_0$ is the time at which coupling starts. In a general context, the coupling algorithm comprises the following stages, illustrated in FIG. 2:

3a—The models are initialized.

The reservoir model is initialized (RINIT) by assigning to the cells of the reservoir grid porosity, permeability, pressure and fluid saturation values. Initialization also comprises the definition of boundary conditions for the reservoir model. These conditions can be defined by a zero flux (no exchange towards the outside of the domain) or by a flux or a pressure imposed on the outer edges of the edge cells of the reservoir model grid (exchange with the outside). The operating conditions in these wells, such as the bottomhole flow rate or pressure, are imposed in a form of an injection record for injectors and of a production record for producers;

The near-wellbore model is initialized (NWINIT) by assigning to the cells of the near-wellbore grid porosity, permeability, pressure and fluid saturation values. This is achieved using techniques for upscaling the results of the reservoir model. These techniques are known. Initialization also comprises defining boundary conditions for the near-wellbore model. These conditions can also be defined using the reservoir model results.

3 b—At least one time step, denoted by $\Delta T$, is defined for exchanging dynamic data between the reservoir model and the near-wellbore model, while modelling over time interval D.

This time step $\Delta T$ can be selected as a function of time step $\Delta TR$ of the flow simulator of the reservoir model, and time step $\Delta TNW$ of the flow simulator of the near-wellbore model ($\Delta TR>\Delta TNW$).

Theoretically, $\Delta T$ must be as small as possible to provide convergence of the solutions in the two models. However, using the time step employed for simulation of the reservoir model is generally sufficient. From a practical point of view however, it is sometimes necessary to carry out a near-wellbore simulation autonomously for a longer time. This is translated into a coupling frequency reduction. This is the reason why, according to the method, time step $\Delta T$ for data exchange between the reservoir model and the near-wellbore model is an adjustable parameter.

Figure 2:
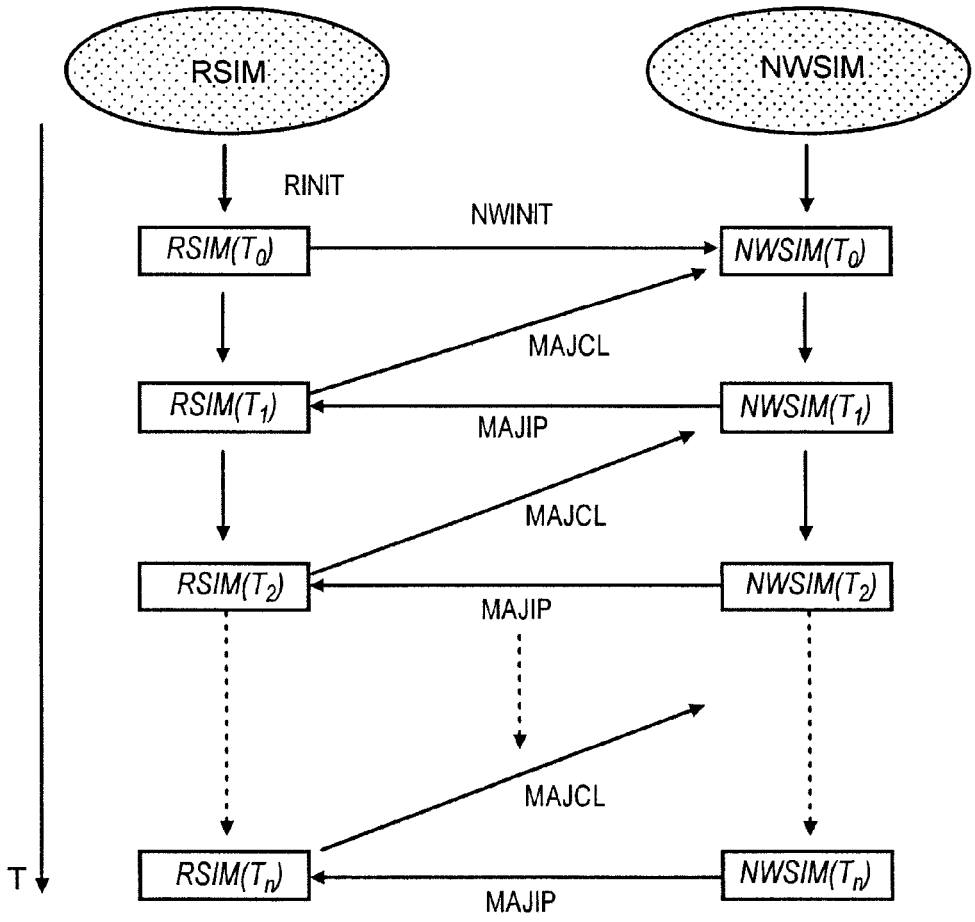
FIG. 2 shows the coupling scheme between the reservoir model and the near-wellbore model wherein axis T corresponds to time.

According to an embodiment, time step $\Delta T$ can vary within time interval D. It is possible to use, for example, a first time step between $T_0$ and $T_i$, and a second time step between $T_i$ and $T_n$. An example of such an application is illustrated hereafter. In FIG. 2, a simulation carried out by the reservoir simulator between $T_0$ and $T_1$ is denoted by $RSIM(T_1)$ and a simulation carried out by the near-wellbore simulator between $T_0$ and $T_1$ is denoted by $NWSIM(T_1)$.

3c—A flow simulation is performed with the reservoir model between time $T_0$ and time $T_1=T_0+\Delta T$.

The results of this simulation are:

The pressure and the fluid saturations at the end of the time step in each cell of the reservoir grid, in particular in the cells that are shared with the cells of the near-wellbore grid, and which will serve as boundary conditions of the near-wellbore model; and The fluid flow rates (water, oil, gas) and the pressures in the injection and production wells are used.

3d—The boundary conditions of the near-wellbore model are updated (MAJCL) using the results of the flow simulation carried out with the reservoir model between $T_0$ and $T_1$ (stage 3c).

The boundary conditions are the values of dynamic data such as pressure or flux saturations in the cells that make up the boundaries of the reservoir or the near-wellbore grid. According to an example, the boundary conditions are defined by a zero flux at all the edges of the near-wellbore grid and by a very high porosity (1,000,000 for example) in all the cells.

Thus, during this stage, the results of the flow simulator of the reservoir model are used to determine values that are imposed as boundary conditions for the flow simulator of the near-wellbore model at the time $T_0$.

The boundary conditions can be calculated at each time step of the near-wellbore model by linear interpolation of the simulation results of the reservoir model between $T_0$ and $T_1$.

3e—A flow simulation in the well vicinity is performed with the near-wellbore model between time $T_0$ and time $T_1$, with the boundary conditions updated in stage 3d.

The results of this simulation are, at least:

the pressure and the fluid saturations at the end of the time step in each cell of the near-wellbore model; and the fluid flow rates (water, oil, gas) and the pressures in the injection or production well depending on the type of well modelled in the near-wellbore model.

These results allow determination of a numerical Productivity

Index (IP).

3f—The connection between the pressure in the cells crossed by a well and the pressures in the well itself is achieved using a numerical Productivity Index (IP). Peaceman's formulas are generally used to calculate this index. The numerical productivity indices of the reservoir model are then updated (MAJIP) using the results of the flow simulation performed with the near-wellbore model between $T_0$ and $T_1$. In fact, if, at the end of the simulation, at time $T_1$, the well results simulated with the near-wellbore model and with the reservoir model are not the same, the numerical productivity indices in the reservoir model are modified so as to adjust the simulation results of the reservoir model to those of the near-wellbore model.

3g—Stages 3c (optionally 3b) to 3f are repeated with a new time interval (from $T_1$ to $T_2$, then from $T_2$ to $T_3$, . . . , then from $T_{n-1}$ to $T_n$)

The numerical productivity index is denoted by IP. It is generally used in flow models to relate the pressures to the flow rate in a well cell of the reservoir or of the near-wellbore grid.

$$Q_{p,i} = \lambda_{p,i} \cdot IP_i \cdot (P_{p,i} - P_{wf,i}) \text{ that is } IP_i = \frac{Q_{p,i}}{\lambda_{p,i} \cdot (P_{p,i} - P_{wf,i})}$$

with:

i is a well cell number in the grid (reservoir or near-wellbore grid)

p is a phase of the fluid. Phases p can be water, oil or gas $Q_{p,i}$ is a flow rate of phase p in well cell i of the grid (reservoir or near-wellbore grid)

$\lambda_{p,i}$ is a mobility of phase p in well cell i of the grid (reservoir or near-wellbore grid) which essentially depends on the relative permeability and on the viscosity of phase p $IP_i$ is a numerical productivity index in well cell i of the grid (reservoir or near-wellbore grid)

$P_{p,i}$ is a pressure of phase p in well cell i of the grid (reservoir or near-wellbore grid)

$P_{wf,i}$ is a pressure in the well, at the bottom, at the reservoir level in well cell of the grid (reservoir or near-wellbore grid).

The numerical productivity index IP accounts for the geometrical effect of well cell i of the grid, the permeability of the porous medium in the well cell and a skin coefficient. A skin coefficient is a well-known coefficient, used to represent well damage in a cell.

Determining a numerical productivity index IP at time $T_1$ can be accomplished by comparing the flow rates simulated with the near-wellbore model and the reservoir model calculated by the following formula:

$$IP_{r,i}(T_1) = \frac{\sum_{j \in W_i} \sum_{p=w,o,g} (P_{nw,p,j}(T_1) - P_{wf,j}(T_1)) IP_{nw,j}}{\sum_{p=w,o,g} (P_{r,p,i}(T_1) - P_{wf,i}(T_1))}$$

with:

i is a well cell number in the grid of a reservoir.

j is a well cell number in the grid of a wellbore.

$W_i$ is a set of well cells of the near-wellbore grid corresponding to a refinement of well cell i of the reservoir grid.

p is a phase of the fluid. Phases p can be water (w), oil (o) or gas (g).

$IP_{r,i}$ is a numerical productivity index in well cell i of the reservoir grid which is used in the reservoir model.

$P_{nw,p,j}$ is a pressure of phase p in well cell j of the near-wellbore grid which is calculated with the near-wellbore model.

$P_{r,p,i}$ is a pressure of phase p in well cell i of the reservoir grid is a calculated with the reservoir model.

$P_{wf,j}$ is a pressure in the well at the reservoir level in well cell j of the near-wellbore grid.

$IP_{nw,j}$ is a numerical productivity index in well cell j of the near-wellbore grid which is used in the near-wellbore model. Variables $IP_i$, $P_{nw,p,j}$, and $P_{wf,j}$ depend on time T.

For a problem of pressure $P_{wf}$ imposed on the well, and in the single-phase case (index p can be removed), the above formula is equivalent to the expression as follows:

$$IP_{r,i}(T_1) = \frac{Q_{nw,i}(T_1)}{Q_{r,i}(T_1)} IP_{r,i}(T_0)$$

with:

$Q_{nw,i}$ the fluid flow rate (single phase) calculated with the near-wellbore model in the section corresponding to the part of the well in well cell i of the reservoir grid $Q_{r,i}$ is the fluid flow rate (single phase) calculated with the reservoir model in the same section, corresponding to the part of the well in well cell i of the reservoir grid.

$IP_{r,i}(T_1)$ and $IP_{r,i}(T_0)$ are the numerical productivity indices at times $T_1$ and $T_0$ respectively, that is before and after updating.

This formula clearly shows that calculating the numerical productivity index corresponds to the correction of the fluid flow rate of the reservoir model in relation to the fluid flow rate of the near-wellbore model. If the two models give the same result in terms of flow rate, then $$\frac{Q_{nw,i}(T_1)}{Q_{r,i}(T_1)} = 1$$

and therefore $IP_{r,i}(T_1) = IP_{r,i}(T_0)$.

4—Determination of the Optimum Exploitation Scenario

The optimum scenario can be selected by testing various scenarios, characterized for example by various respective locations of the injector and producer wells, and by simulating the production of hydrocarbons for each one of the wells according to stage 3. The optimum scenario is the scenario allowing obtaining an optimum reservoir production within the context of the production of a reservoir, or the scenario allowing obtaining optimum injectivity in the reservoir within the context of fluid injection in the reservoir (injection of water for enhanced production or injection of acid gas).

The scenario selected in stage 1 is modified (ΔSCE), for example by modifying the location of a well, in order to test various exploitation scenarios.

Exploitation of the reservoir is then optimized by implementing, in the field, the selected production scenario.

According to the invention, it is quite possible to couple a reservoir model with several near-wellbore models.

Variants

According to a particular embodiment of the invention, stage 2 is modified where the grids are constructed.

The simulation using the reservoir model in stage 3c provides dynamic fluid data such as the pressure or the saturations in the period going from $T_0$ to $T_1$ over all the coarse cells. However, determination of the boundary conditions in stage 3b requires interpolation of the pressure or of the flux at the edges of the near-wellbore model. In order to reduce errors in the interpolation, upon grid generation, the edge cells of the near-wellbore model may be constrained so that they coincide with the interfaces of the cells of the reservoir model. Furthermore, the edge cells in the near-wellbore model are also constrained to coincide with cells of the reservoir model (FIG. 3). Transfer of the dynamic data from the reservoir model to the near-wellbore model is thus direct for these cells. In the near-wellbore model itself, the boundary conditions are zero flux. In order to maintain the dynamic properties at the edges of the model, porosities of very high value (1,000,000 for example) are assigned to the edge cells. These types of boundary conditions are consistent with most flow models and implementation thereof is simple.

For some problems, flow changes around the well are linked with multiphase flows. In this case, also the numerical productivity indices per phase are updated. The pressure/flow rate relation is therefore reformulated by introducing a coefficient referred to as "productivity index multiplier:"

$$Q_{p,i}\lambda_{p,i}\cdot M_{p,i}\cdot IP_i\cdot(P_{p,i}-p_{wf,i})$$

$M_{p,i}$ is the productivity index multiplier for phase p in well cell i.

If the physics around the well are linked with the multiphase flows, it is possible to update the IP multiplier instead of the IP itself, using the formula as follows:

$$M_{p,i}(T_1)=\frac{Q_{nw,p,i}(T_1)}{Q_{r,p,i}(T_1)}M_{p,i}(T_0)$$

with:

$Q_{r,p,i}(T_1)$ is a flow rate of phase p calculated by the reservoir model in well cell i of the reservoir grid at time $T_1$.

$Q_{nw,p,i}(T_1)$ is a flow rate of phase p calculated by the near-wellbore model in the same well area (see set $W_i$) at time $T_1$.

$M_{p,i}(T_0)$ is the numerical productivity index multiplier for phase p in the reservoir model at times $T_0$ (prior to updating the model).

$M_{p,i}(T_0)$ is the numerical productivity index multiplier for phase p in the reservoir model at times $T_0$ (after updating the model).

Application Examples

The coupling method according to the invention can be used for modelling various detailed phenomena around the well such as, for example, damage due to drilling or completion fluid, acid stimulation, non-Darcyan flow around the well, condensate gas problems, asphaltene deposition, damage due to $CO_2$ injection, water or gas inflow prevention, sand encroachment, mineral deposits, completion impact, etc. Here, in particular, is presented an application example for damage to the petroleum formation by the drilling fluid during well drilling and an application example for water inflow prevention when a well under production produces a large amount of water in which this water production is to be reduced.

In order to further simplify the coupling method, the data are updated using the values at the time $T_n$ instead of the linear interpolation at a time between $T_n$ and $T_{n+1}$, for simulation of the near-wellbore model in the period from $T_n$ to $T_{n+1}$. This choice is interesting because it allows parallel simulations on various machines for the reservoir model and the near-wellbore model.

1) Application to Oil Formation Damage Due to the Drilling Fluid

A standard reservoir model is used for field simulation. The near-wellbore model developed by DING, Y. and RENARD, G.: "Evaluation of Horizontal Well Performance after Drilling Induced Formation Damage" J. of Energy Resources Technology, Vol. 127, September, 2005, is used to simulate formation damage through drilling. The advanced physics of the damage are not modelled in the field simulation with the reservoir model.

Figure 6:
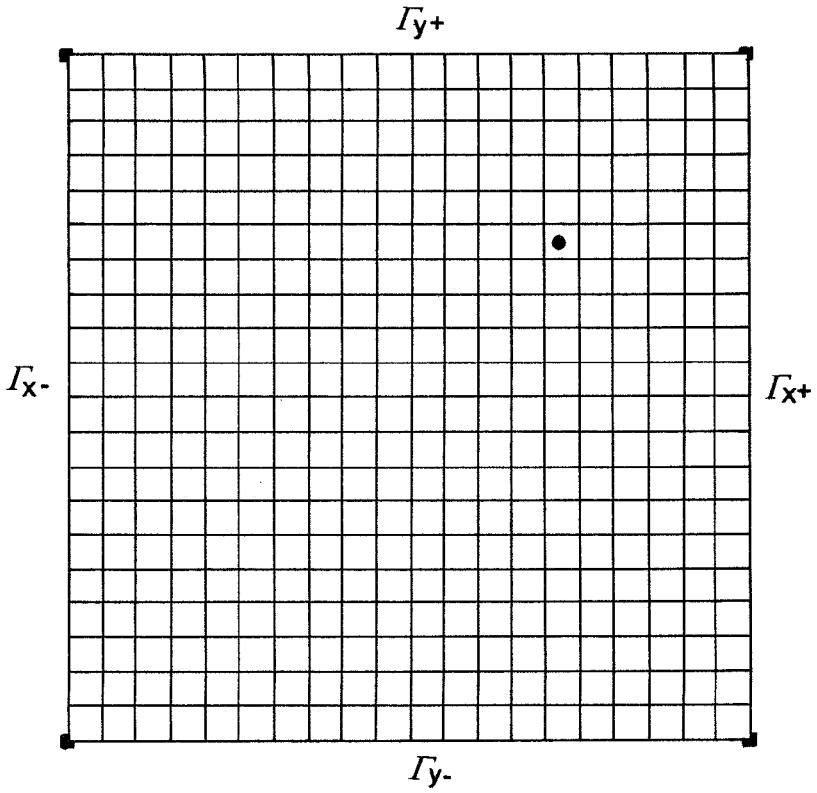
FIG. 6 shows the coarse grid for field simulation in the case of well damage by the drilling fluid wherein $\Gamma_{x-}$ and $\Gamma_{x+}$ correspond to two boundaries of the grid in direction x, and $T_{y-}$ and $T_{y+}$ correspond to two boundaries of the grid in direction y.

A 1000 m×1000 m×10 m reservoir is considered. A Cartesian grid with 20 cells in direction x, 20 cells in direction y and 1 cell in direction z is used for field simulation (FIG. 6). The cell sizes thus are 50 m×50 m×10 m. The initial reservoir pressure is 200 bars. A producer well is to be drilled in block (15, 15, 1). It is represented by a black circle in FIG. 6. The damage caused to this well by the drilling fluid is studied with the method according to the invention.

The reservoir is homogeneous, with permeability 200 mD and porosity 0.15. The boundary conditions of this reservoir are zero fluxes, except at edge $\Gamma_{x-}$ (FIG. 6), where the pressure is constant (200 bars).

Figure 7:
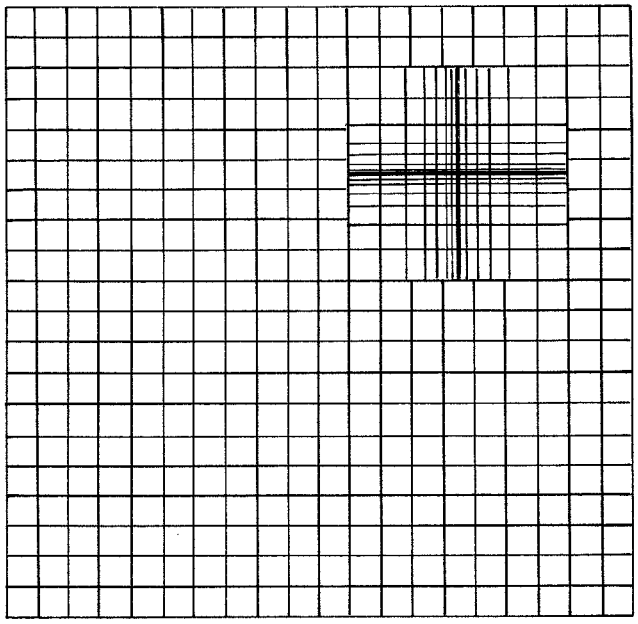
FIG. 7 shows the grid locally refined around the well for simulating the reference solution in the case of well damage by drilling fluid.
Figure 8A:
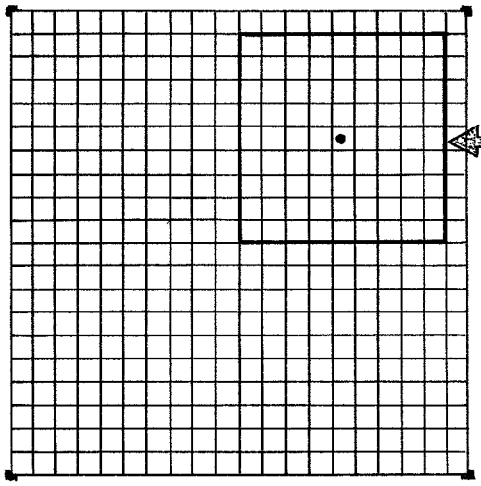
FIGS. 8A and 8B show the coupling grids for simulating well damage due to the drilling fluid wherein grid FIG. 8A corresponds to the grid for field simulation, and FIG. 8B corresponds to the grid in the near-wellbore model.
Figure 8B:
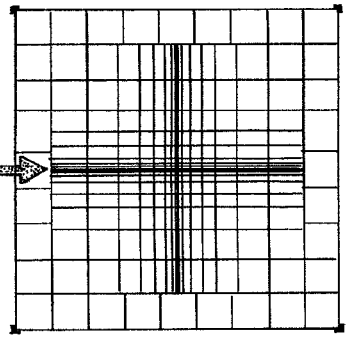

To obtain the reference solution, the grid is refined around the well (FIG. 7). A specific model that accounts for the advanced physics of the damage is used on this grid to simulate the reference solution. Since the damage caused by the drilling fluid is generally limited from centimeters to 10, 20 or 30 or more centimeters around the well, very small cells are needed in the refined zone (Table 1). The well diameter is 21.6 cm. For the well to be included in a cell, the size of the well cell is 22 cm. The other cells around the well are much smaller with a size of 2 cm. The grids used for coupling are illustrated in FIGS. 8A and 8B. The grid of the near-wellbore model (FIG. 8B) corresponds to the refined area and to the surrounding cells in the reference grid. The cells at the edges of the near-wellbore model coincide with cells of the reservoir model.

TABLE 1

| Size of the cells around the well | |
|---|---|
| Cell size in direction x (m) | Cell size in direction y (m) |
| 50 42.7 30 20 16 8 4 2 1 0.51 0.3 0.16 0.08 0.04 0.02 0.02 0.02 0.02 0.02 0.22 0.02 0.02 0.02 0.02 0.02 0.04 0.08 0.16 0.3 0.51 1 2 4 8 16 20 30 42.7 50 | 50 42.7 30 20 16 8 4 2 1 0.51 0.3 0.16 0.08 0.04 0.02 0.02 0.02 0.02 0.02 0.22 0.02 0.02 0.02 0.02 0.02 0.04 0.08 0.16 0.3 0.51 1 2 4 8 16 20 30 42.7 50 |

Figure 9:
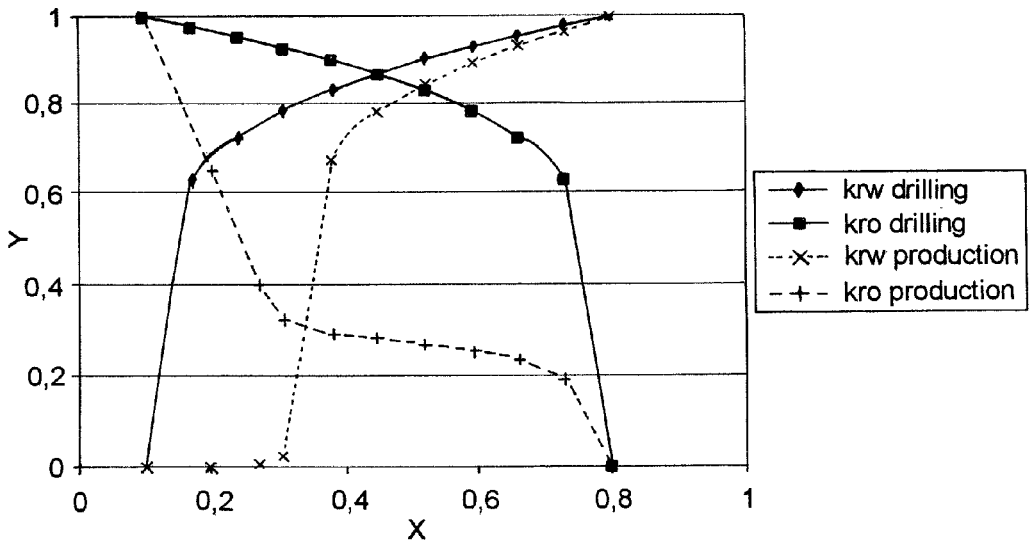
FIG. 9 shows the relative permeabilities during drilling and production wherein axis X is the unitless saturation, axis Y is the relative permeability, there is no unit, curve "krw drilling" is the relative permeability curve of the water during drilling, curve "kro drilling" is the relative permeability curve of the oil during drilling, and curves "krw production" and "kro production" are the relative permeability curves of water and oil respectively during production.

It is assumed that the reservoir is thick and that this model corresponds only to the first layer of the reservoir. The contact time between the drilling fluid and the reservoir is 2 days. The pressure during drilling at the well bottom is 250 bars. The permeability and the thickness of the external cake formed by the drilling mud are 0.001 mD and 0.2 cm. The thickness of the internal cake is 2 cm with a mean permeability reduced to 20 mD during the drilling period and of 40 mD during the production period. The viscosity of the drilling fluid is 30 cPo. The hysteresis of the relative permeability between the drilling period and the production period is shown in FIG. 9. An irreducible water saturation of 30% linked with the filtrate (drilling fluid) that invades the formation during the drilling stage remains in the porous medium when the well is produced again.

Figure 10A:
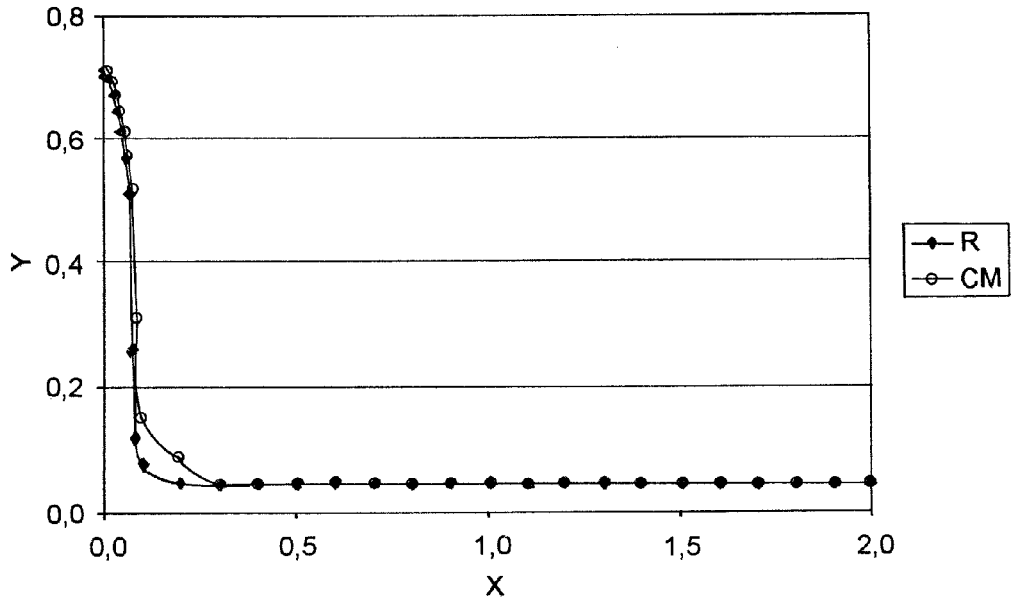
Figure 10B:
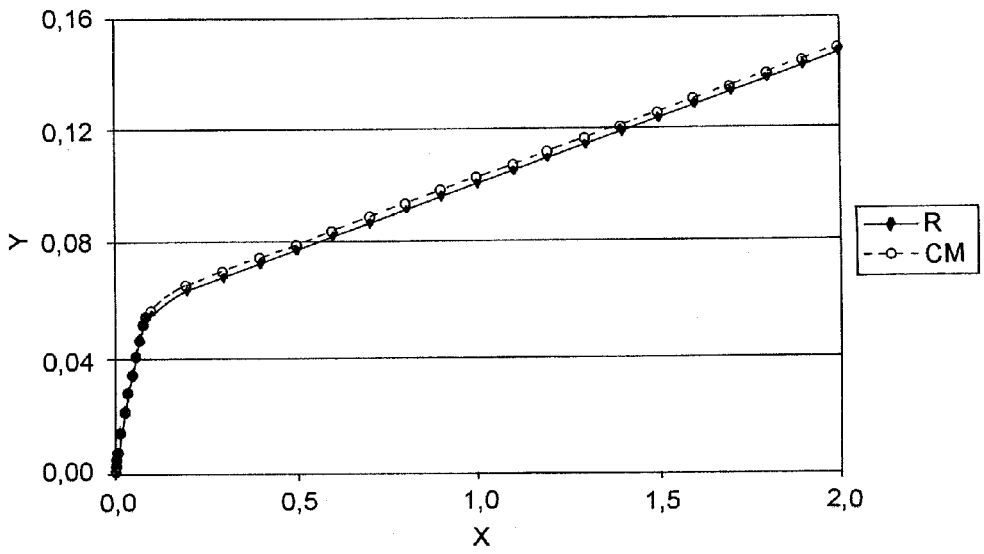

The drilling fluid invasion volumes are compared in FIG. 10 for the simulation with the coupling method and the reference solution obtained using the grid with the local refinement (FIG. 7). The time steps for updating the data in the coupling are presented in Table 2. FIG. 10 shows that the fluid invasion volume is correctly simulated with the coupling method. The small difference between the coupling method and the reference solution in the period between 0.1 and 0.3 day can be improved using small time iteration steps to exchange data in the coupling.

TABLE 2

Time step for data updating in the coupling

| Period (day) | Time step (day) |
|---|---|
| 0-0.01 | 0.001 |
| 0.01-0.1 | 0.01 |
| 0.1-3 | 0.1 |
| 3-10 | 1 |
| 10-200 | 10 |

Figure 11:
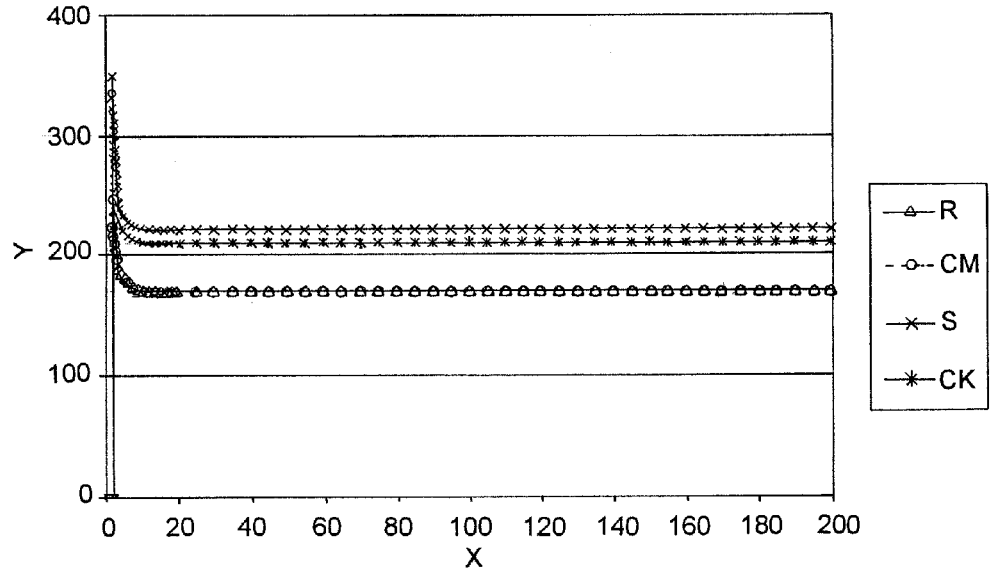
FIG. 11 compares the oil production flow rates wherein axis X is the time in days, the axis Y is the flow rate in $m^3$/day, curve R is the reference solution, curve CM is the simulation with the coupling method, curve S is the simulation without well damage, and curve CK is the simulation with well damage due to the drilling muds (cakes) only.

After 2 days of drilling, the well is closed for 1 day for completion, then production is started. Coupling is performed until the $10^{th}$ day. After 10 days, the effect of the damage around the well becomes stable and the numerical productivity indices in the reservoir model practically change no more. Coupling is no longer needed to continue field simulation with the reservoir model. The oil production curve simulated by the reservoir model that is coupled with the near-wellbore model during the first 10 days is shown in FIG. 11. This curve is very close to the reference solution.

If the damage is not accounted for or if only the presence of the cakes is considered in the simulation, the results are very imprecise with errors above 20% (FIG. 11). Taking into account phenomena around wells such as damage due to the drilling fluid is important for reservoir management and the coupling method provided is perfectly suitable for simulation of this type of problem.

2) Application to Water Inflow Prevention

In the water inflow prevention procedure, a polymer solution is injected into a producer well for a short time in order to reduce the large amount of water production simultaneously with oil. Part of the polymer is absorbed on the rock and another part is dispersed in the water. The polymer injected has the effect of reducing the mobility of the water phase by increasing the viscosity thereof and by decreasing the relative permeability of this phase. Thus, in the coupling method, the most suitable approach updates the numerical IP multiplier for the water phase.

Figure 12:
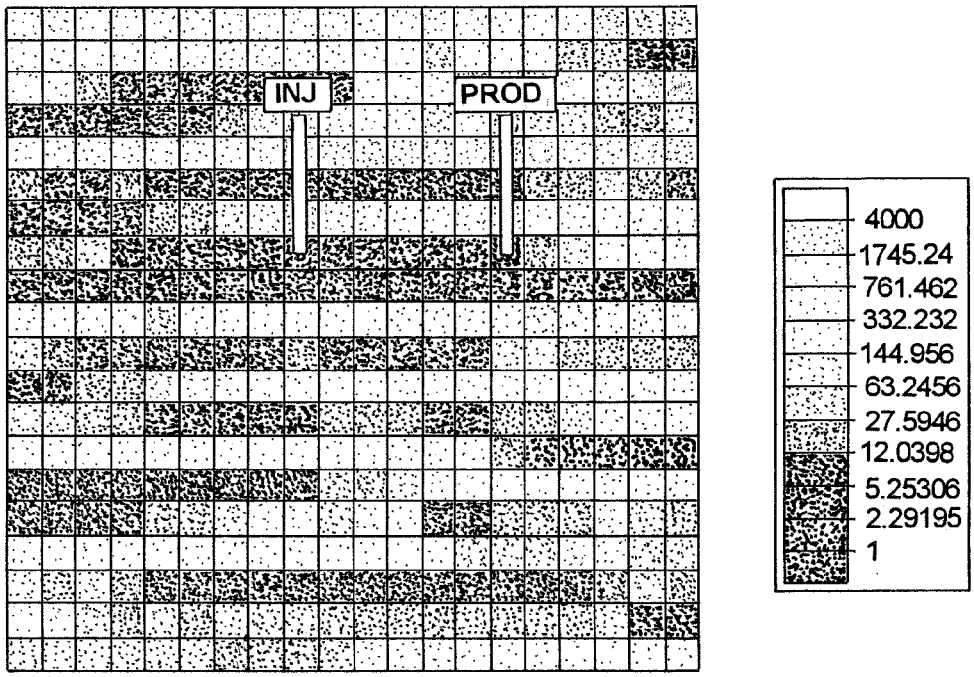
FIG. 12 shows the permeabilities in layer 3 on the coarse grid of the reservoir model in the application to water inflow prevention wherein there is an injector and a producer.

A 1000 m×1000 m×25 m reservoir is considered by way of example. A Cartesian grid with 20 cells in direction x, 20 cells in direction y and 5 cells in direction z is used for field simulation. The cell size thus is 50 m×50 m×5 m. The reservoir is heterogeneous. The permeability is shown in FIG. 12. The permeability ratio in the vertical and horizontal directions is 0.1. The initial reservoir pressure is 200 bars.

There is an injector well (INJ) and a producer well (PROD) shown in FIG. 12. The pressure imposed on the injector well is 300 bars and the producer well pressure is constrained to 150 bars during production. After production, during 1000 days, the water cut (ratio of water to the total volume) of the producer well reaches 85%. The water inflow prevention procedure is then applied to reduce the amount of water produced. A polymer solution with a concentration of 2500 ppm is injected into the producer with a bottomhole pressure of 300 bars for 2 days. The well is then produced again. This water inflow prevention procedure is simulated with the method according to the invention.

Figure 13:
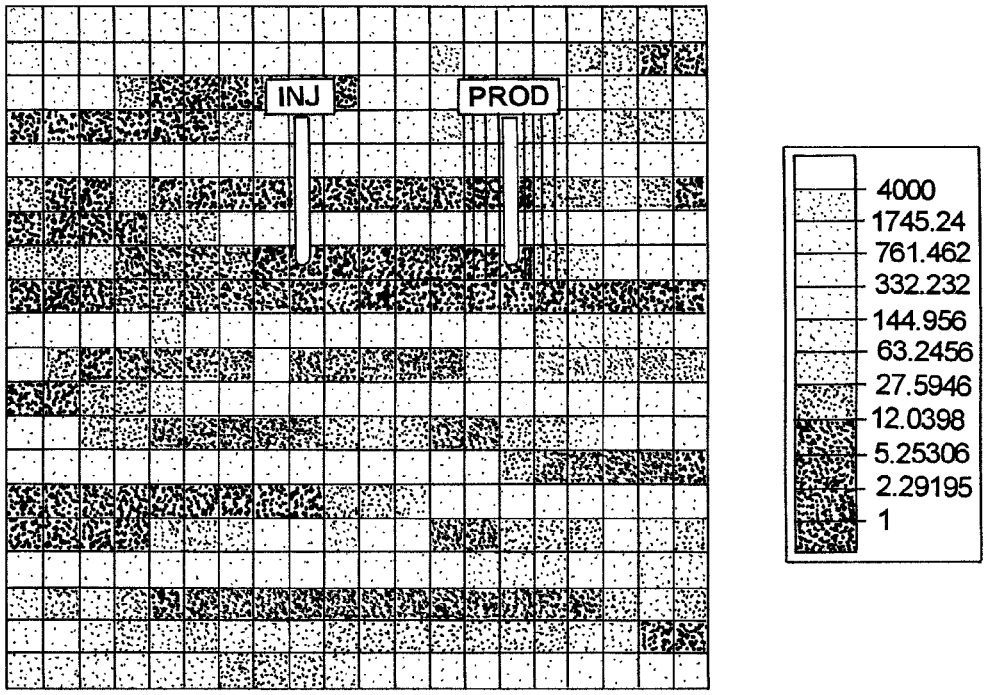
FIG. 13 shows the grid refined around the producer for simulating the reference solution.
Figure 16A:
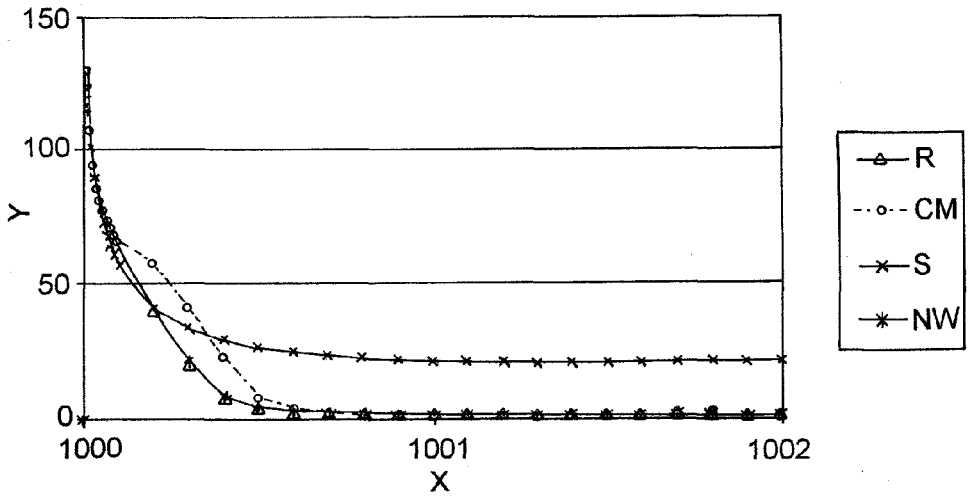
Figure 16B:
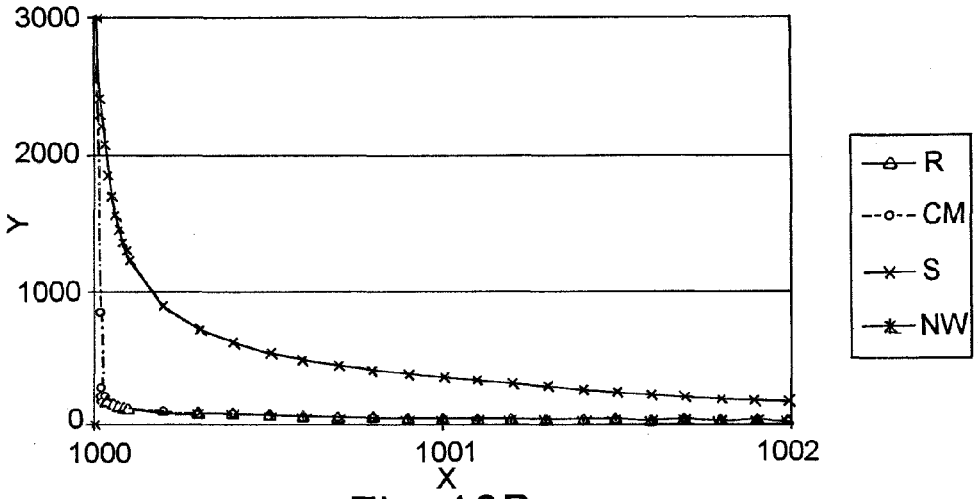
Figure 16C:
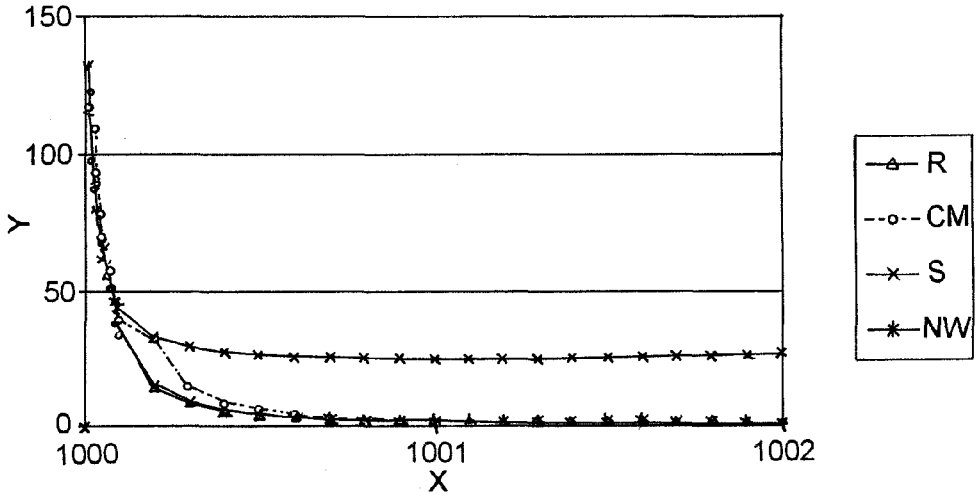
Figure 16D:
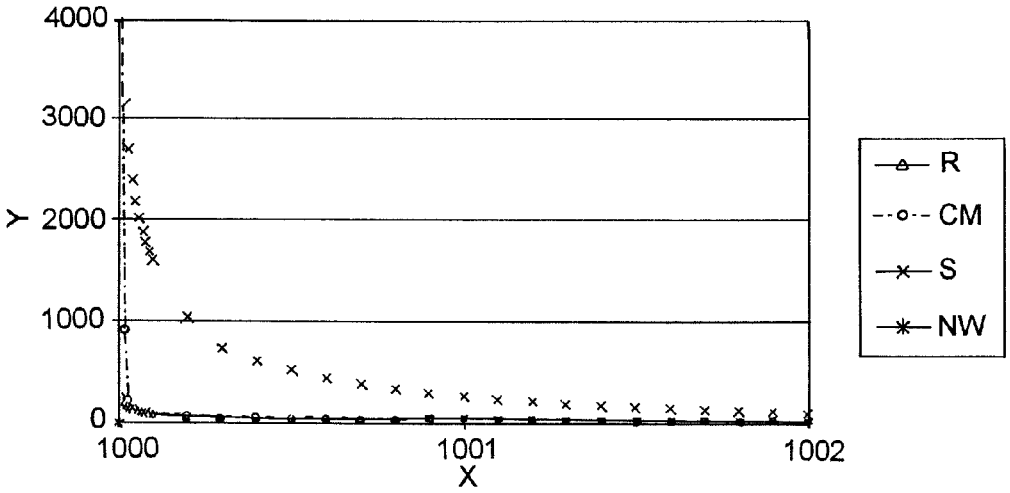
Figure 16E:
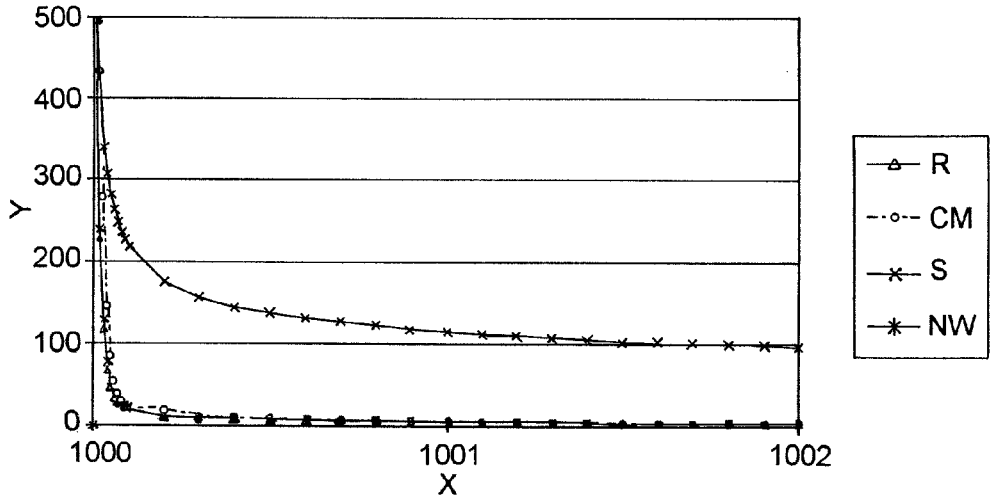

In order to have a reference solution, a local refinement around the producer well is used (FIG. 13). The size of the cells around the well is 0.617 m in direction x. The grid for the coupling is presented in FIG. 14. Cells at the edges of the near-wellbore model coincide with cells in the reservoir model. The physics of the polymer can be considered in both models (near-wellbore model and reservoir model).

TABLE 3

Time step during coupling

| Period (day) | Time step (day) |
|---|---|
| 0-950 | — |
| 950-970 | 2 |
| 970-1000 | 28 |
| 1000-1000.1 | 0.01 |
| 1000.1-1005 | 0.1 |
| 1005-1030 | 1 |
| 1030-1100 | 2 |
| 1100-3000 | — |

Coupling starts at 950 days and it ends at 1100 days, that is a period of 150 days in total. The time steps for data exchanges in the coupling method are presented in Table 3. During the first 50 days (from 950 to 1000 days) of coupling, no polymer is injected. This period is only used to ensure good initialization of the near-wellbore model. The overall numerical IPs are updated at coupling start (from 950 to 970 days) so as to take into account the effects of the grids between the reservoir model and the near-wellbore model. During the polymer injection period (between 1000 and 1002 days), the overall numerical IPs are again recalculated to integrate the effect induced by the polymer injected (the numerical IP multipliers could also be updated for the water phase). However, when the well is produced again (1003 days), the numerical IP multipliers for the water phase are updated.

FIG. 15 compares the flow rates of polymer injection in the well for the various simulations: reference solution, simulation on the reservoir grid with coupling, direct simulation on the reservoir grid without coupling and simulation with the near-wellbore model (with coupling). FIGS. 16A to 16E show the same comparisons layer by layer. For the direct simulation with the reservoir grid without coupling, the volume of polymer injected is widely overestimated. When simulation of the coarse grid is coupled with the near-wellbore model, the results are significantly improved. At the start of coupling, the injection flow rate is high, but it is rapidly corrected by updating the IP due to the coupling. If higher accuracy is desired for the polymer injection flow rate, the simulation results need to be referenced with the near-wellbore model. With this model, the volume injected and the distribution of the polymer around the well are both correctly simulated.

Figure 17:
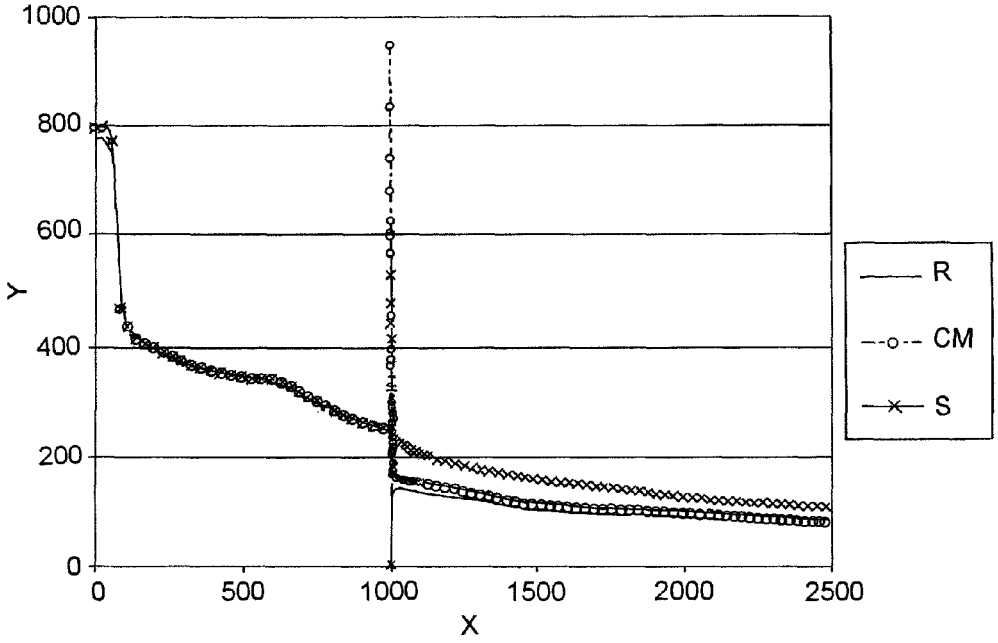
FIG. 17 shows the oil flow rate of the producer wherein the axis X is the time in days, the axis Y is the oil flow rate in $m^3$/day, curve R is the reference solution, curve CM is the simulation of the reservoir model with the coupling method and curve S is the direct simulation with the reservoir model without coupling.
Figure 18:
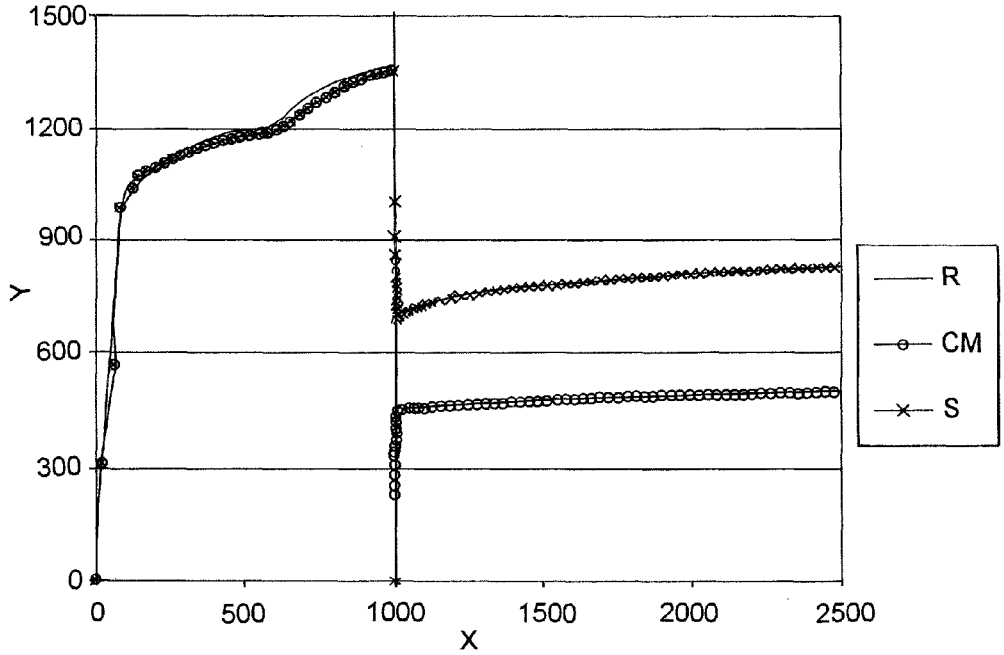
FIG. 18 shows the water flow rate of the producer, wherein the axis X is the time in days, the axis Y is the water flow rate in $m^3$/day, curve R is the reference solution, curve CM is the simulation of the reservoir model with the coupling method and curve S is the direct simulation with the reservoir model without coupling.
Figure 19:
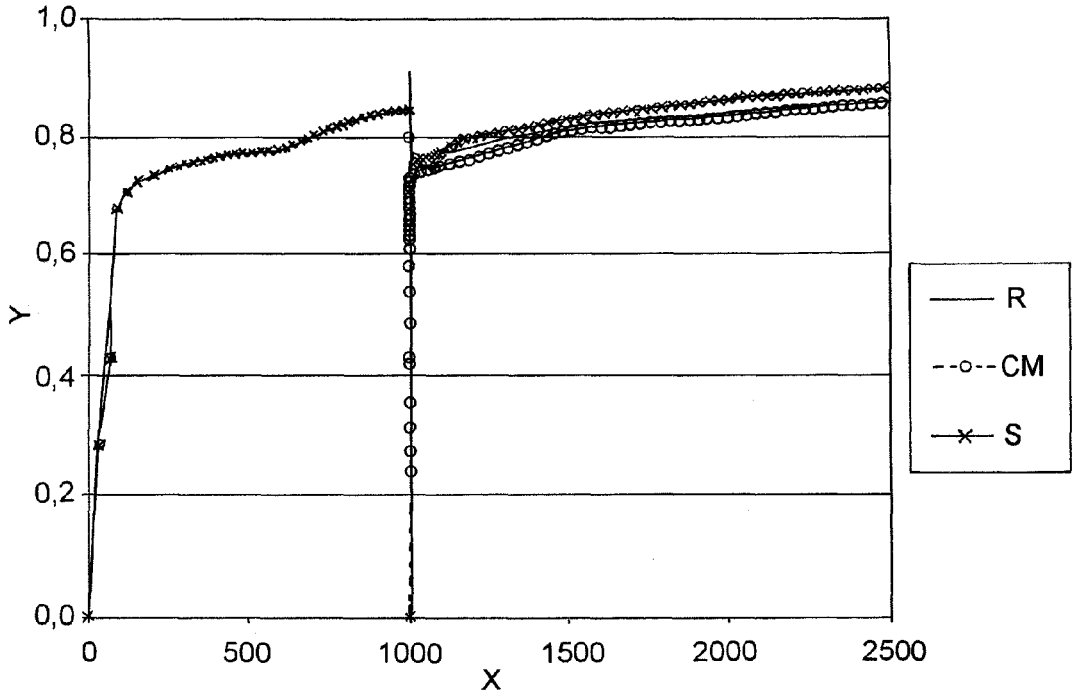
FIG. 19 shows the water cut curve of the producer, wherein axis X is the time expressed in days, the axis Y is the unitless water cut, curve R is the reference solution, curve CM is the simulation of the reservoir model with the coupling method and curve S is the direct simulation with the reservoir model without coupling.
Figure 20A:
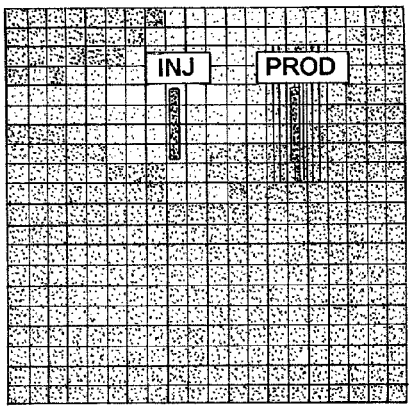
FIGS. 20A to 20D show a map of water saturation after 1100 days wherein FIG. 20A corresponds to the reference solution in the field, FIG. 20B corresponds to the map obtained with the coarse-grid reservoir model with coupling.
Figure 20B:
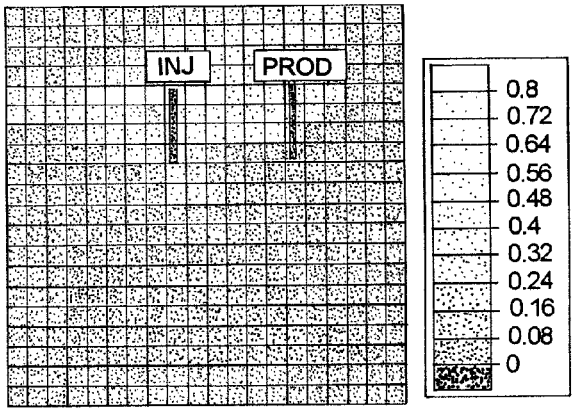
Figure 20C:
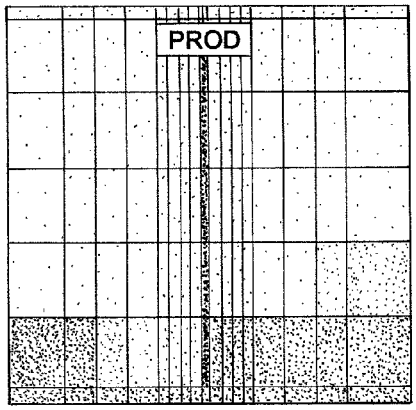
Figure 20D:
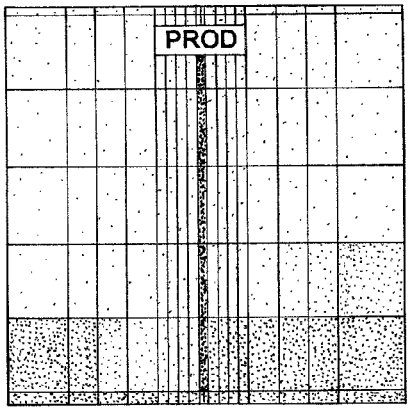
Figure 21A:
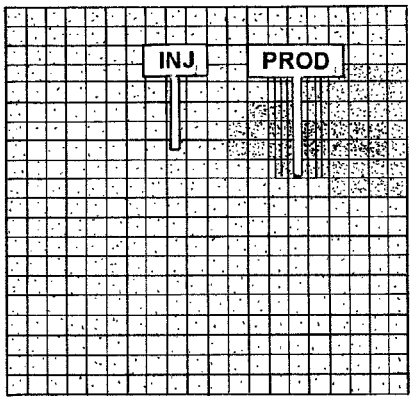
Figure 21B:
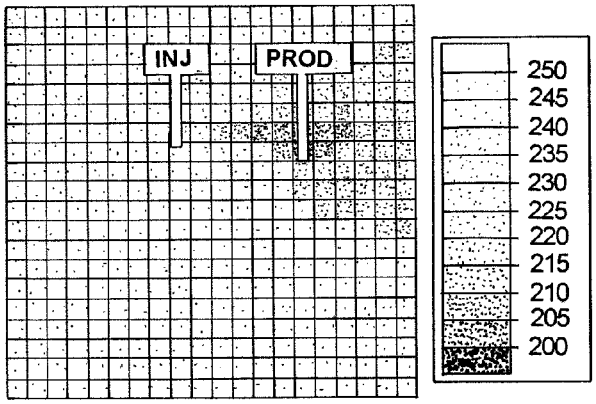
Figure 21C:
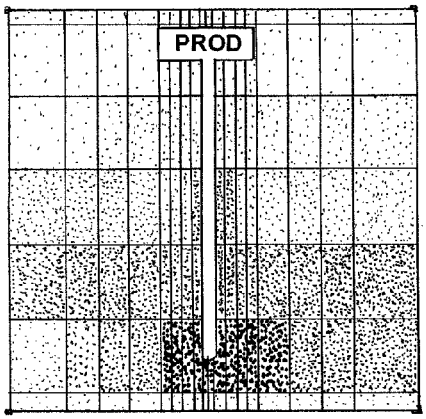
Figure 21D:
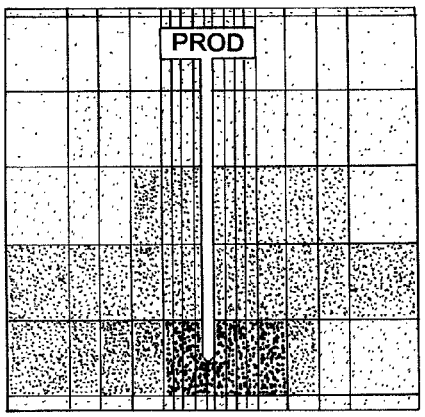

FIGS. 17, 18 and 19 respectively show the oil and water flow rate and water cut curves for the reservoir model with coupling, the reservoir model without coupling and the reference solution. The results of the reservoir model with coupling are globally satisfactory. FIG. 20 shows the water saturation map at the coupling end (1100 days) and FIG. 21 shows the pressure map at 1100 days. Compared with the reference solutions, coupling gives globally satisfactory results.

The invention claimed is:

1. A computer-implemented method for modelling fluid flows within a porous medium traversed by at least one well comprising:

a) using a first computer implemented flow simulator for simulating flow of fluids within the porous medium from numerical productivity indices relating fluid pressures to fluid flow rates and a second computer implemented flow simulator for simulating flow of fluids in a wellbore region from boundary conditions of the wellbore region;

b) simulating fluid flows within the medium from the numerical productivity indices with the first simulator over a predetermined time interval between times $T_0$ and $T_1$ and determining therefrom updated boundary conditions for the second simulator;

c) simulating fluid flows in the wellbore region using the second simulator over the predetermined time interval using the updated boundary conditions and determining updated numerical productivity indices for the first simulator; and d) modelling the fluid flows within the porous medium for a period of time between $T_0$ and $T_n$ where $T_n > T_1$, by repeating b) and c) for successive time intervals between $T_0$ and $T_n$.

2. A method as claimed in claim 1, wherein each successive time interval has a length depending on a calculating time step of the first computer implemented flow simulator and on a time step of the second computer flow simulator.

3. A method as claimed in claim 1, wherein each successive time interval has a length equal to the time step of the first computer implemented flow simulator.

4. A method as claimed in claim 1, wherein the boundary conditions are determined by linear interpolation of results of the first computer implemented flow simulator between the start times and the end times of each successive time interval.

5. A method as claimed in claim 2, wherein the boundary conditions are determined by linear interpolation of results of the first computer implemented flow simulator between the start times and the end times of the successive time intervals.

6. A method as claimed in claim 3, wherein the boundary conditions are determined by linear interpolation of results of the first computer implemented flow simulator between the start times and the end times of the successive time intervals.

7. A method as claimed in claim 1, updating the numerical productivity indices by comparing the flow rates simulated by the first computer implemented flow simulator and the second computer implemented flow simulator which are calculated with the following formula:

$$IP_{r,i}(T_1) = \frac{\sum_{j \in W_i} \sum_{p=w,o,g} (P_{nw,p,j}(T_1) - P_{wf,j}(T_1)) IP_{nw,j}}{\sum_{p=w,o,g} (P_{r,p,i}(T_1) - P_{wf,i}(T_1))}$$

wherein:

i is a well cell number in a grid of a reservoir;

j is a well cell number in a grid of the wellbore region;

$W_i$ is a set of well cells of the grid of the wellbore region corresponding to a refinement of well cell i of the grid of the reservoir;

p is a phase of the fluid wherein phases p can be water (w), oil (o) or gas (g);

$IP_{r,i}$ is the numerical productivity index in well cell i of the grid of the reservoir which is used in the model of the reservoir;

$P_{nw,p,j}$ is a pressure of phase p in well cell j of the grid of the wellbore region which is calculated with the wellbore model;

$P_{r,p,i}$ is a pressure of phase p in well cell i of the grid of the reservoir is calculated with the model of the reservoir;

$P_{wf,i}$ is a pressure in the at least one well at a reservoir level of the reservoir in well cell j of the grid of the wellbore region;

$IP_{nw,j}$ is the numerical productivity index in well cell j of the grid of the wellbore region which is used in the model of the wellbore region; and variables $IP_i$, $P_{nw,p,j}$, $P_{r,p,i}$ and $P_{wf,j}$ depend on time T.

8. A method as claimed in claim 2, updating the numerical productivity indices by comparing the flow rates simulated by the first computer implemented flow simulator and the second computer implemented flow simulator which are calculated with the following formula:

$$IP_{r,i}(T_1) = \frac{\sum_{j \in W_i} \sum_{p=w,o,g} (P_{nw,p,j}(T_1) - P_{wf,j}(T_1)) IP_{nw,j}}{\sum_{p=w,o,g} (P_{r,p,i}(T_1) - P_{wf,i}(T_1))}$$

wherein:

i is a well cell number in a grid of a reservoir;

j is a well cell number in a grid of the wellbore region;

$W_i$ is a set of well cells of the grid of the wellbore region corresponding to a refinement of well cell i of the grid of the reservoir;

p is a phase of the fluid wherein phases p can be water (w), oil (o) or gas (g);

$IP_{r,i}$ is the numerical productivity index in well cell i of the grid of the reservoir which is used in the model of the reservoir;

$P_{nw,p,j}$ is a pressure of phase p in well cell j of the grid of the wellbore region which is calculated with the wellbore model;

$P_{r,p,i}$ is a pressure of phase p in well cell i of the grid of the reservoir is calculated with the model of the reservoir;

$P_{wf,j}$ is a pressure in the at least one well at a reservoir level of the reservoir in well cell j of the grid of the wellbore region;

$IP_{nw,j}$ is the numerical productivity index in well cell j of the grid of the wellbore region which is used in the model of the wellbore region; and variables $IP_i$, $P_{nw,p,j}$, $P_{r,p,i}$ and $P_{wf,j}$ depend on time T.

9. A method as claimed in claim 3, updating the numerical productivity indices by comparing the flow rates simulated by the first computer implemented flow simulator and the second computer implemented flow simulator which are calculated with the following formula:

$$IP_{r,i}(T_1) = \frac{\sum_{j \in W_i} \sum_{p=w,o,g} (P_{nw,p,j}(T_1) - P_{wf,j}(T_1)) IP_{nw,j}}{\sum_{p=w,o,g} (P_{r,p,i}(T_1) - P_{wf,i}(T_1))}$$

wherein:

i is a well cell number in a grid of a reservoir;

j is a well cell number in a grid of the wellbore region;

$W_i$ is a set of well cells of the grid of the wellbore region corresponding to a refinement of well cell i of the grid of the reservoir;

p is a phase of the fluid wherein phases p can be water (w), oil (o) or gas (g);

$IP_{r,i}$ is the numerical productivity index in well cell i of the grid of the reservoir which is used in the model of the reservoir;

$P_{nw,p,j}$ is a pressure of phase p in well cell j of the grid of the wellbore region which is calculated with the wellbore model;

$P_{r,p,i}$ is a pressure of phase p in well cell i of the grid of the reservoir is calculated with the model of the reservoir;

$P_{wf,j}$ is a pressure in the at least one well at a reservoir level of the reservoir in well cell j of the grid of the wellbore region;

$IP_{nw,j}$ is the numerical productivity index in well cell j of the grid of the wellbore region which is used in the model of the wellbore region; and variables $IP_i$, $P_{nw,p,j}$, $P_{r,p,i}$ and $P_{wf,j}$ depend on time T.

10. A method as claimed in claim 4, updating the numerical productivity indices by comparing the flow rates simulated by the first computer implemented flow simulator and the second computer implemented flow simulator which are calculated with the following formula:

$$IP_{r,i}(T_1) = \frac{\sum_{j \in W_i} \sum_{p=w,o,g} (P_{nw,p,j}(T_1) - P_{wf,j}(T_1)) IP_{nw,j}}{\sum_{p=w,o,g} (P_{r,p,i}(T_1) - P_{wf,i}(T_1))}$$

wherein:

i is a well cell number in a grid of a reservoir;

j is a well cell number in a grid of the wellbore region;

$W_i$, is a set of well cells of the grid of the wellbore region corresponding to a refinement of well cell i of the grid of the reservoir;

p is a phase of the fluid wherein phases p can be water (w), oil (o) or gas (g);

$IP_{r,i}$ is the numerical productivity index in well cell i of the grid of the reservoir which is used in the model of the reservoir;

$P_{nw,p,j}$ is a pressure of phase p in well cell j of the grid of the wellbore region which is calculated with the wellbore model;

$P_{r,p,i}$ is a pressure of phase p in well cell i of the grid of the reservoir is calculated with the model of the reservoir;

$P_{wf,j}$ is a pressure in the at least one well at a reservoir level of the reservoir in well cell j of the grid of the wellbore region;

$IP_{nw,j}$ is the numerical productivity index in well cell j of the grid of the wellbore region which is used in the model of the wellbore region; and variables $IP_i$, $P_{nw,p,j}$, $P_{r,p,i}$ and $P_{wf,j}$ depend on time T.

11. A method as claimed in claim 5, updating the numerical productivity indices by comparing the flow rates simulated by the first computer implemented flow simulator and the second computer implemented flow simulator which are calculated with the following formula:

$$IP_{r,i}(T_1) = \frac{\sum_{j \in W_i} \sum_{p=w,o,g} (P_{nw,p,j}(T_1) - P_{wf,j}(T_1)) IP_{nw,j}}{\sum_{p=w,o,g} (P_{r,p,i}(T_1) - P_{wf,i}(T_1))}$$

wherein:

i is a well cell number in a grid of a reservoir;

j is a well cell number in a grid of the wellbore region;

$W_i$ is a set of well cells of the grid of the wellbore region corresponding to a refinement of well cell i of the grid of the reservoir;

p is a phase of the fluid wherein phases p can be water (w), oil (o) or gas (g);

$IP_{r,i}$ is the numerical productivity index in well cell i of the grid of the reservoir which is used in the model of the reservoir;

$P_{nw,p,j}$ is a pressure of phase p in well cell j of the grid of the wellbore region which is calculated with the wellbore model;

$P_{r,p,i}$ is a pressure of phase p in well cell i of the grid of the reservoir is calculated with the model of the reservoir;

$P_{wf,j}$ is a pressure in the at least one well at a reservoir level of the reservoir in well cell j of the grid of the wellbore region;

$IP_{nw,j}$ is the numerical productivity index in well cell j of the grid of the wellbore region which is used in the model of the wellbore region; and variables $IP_i$, $P_{nw,p,j}$, $P_{r,p,i}$ and $P_{wf,j}$ depend on time T.

12. A method as claimed in claim 6, updating the numerical productivity indices by comparing the flow rates simulated by the first computer implemented flow simulator and the second computer implemented flow simulator which are calculated with the following formula:

$$IP_{r,i}(T_1) = \frac{\sum_{j \in W_i} \sum_{p=w,o,g} (P_{nw,p,j}(T_1) - P_{wf,j}(T_1)) IP_{nw,j}}{\sum_{p=w,o,g} (P_{r,p,i}(T_1) - P_{wf,i}(T_1))}$$

wherein:

i is a well cell number in a grid of a reservoir;

j is a well cell number in a grid of the wellbore region;

$W_i$ is a set of well cells of the grid of the wellbore region corresponding to a refinement of well cell i of the grid of the reservoir;

p is a phase of the fluid wherein phases p can be water (w), oil (o) or gas (g);

$IP_{r,i}$ is the numerical productivity index in well cell i of the grid of the reservoir which is used in the model of the reservoir;

$P_{nw,p,j}$ is a pressure of phase p in well cell j of the grid of the wellbore region which is calculated with the wellbore model;

$P_{r,p,i}$ is a pressure of phase p in well cell i of the grid of the reservoir is calculated with the model of the reservoir;

$P_{wf,j}$ is a pressure in the at least one well at a reservoir level of the reservoir in well cell j of the grid of the wellbore region;

$IP_{nw,j}$ is the numerical productivity index in well cell j of the grid of the wellbore region which is used in the model of the wellbore region; and variables $IP_i$, $P_{nw,p,j}$, $P_{r,p,i}$ and $P_{wf,j}$ depend on time T.

13. A method as claimed in claim 1, wherein the fluid flows within the medium are simulated using the first computer implemented flow simulator with a first grid discretizing the porous medium into a set of cells and fluid flows in the wellbore region are simulated using the second computer implemented simulator with a second grid discretizing the well in the wellbore region with a set of cells, the second grid being generated by constraining cells located at an edge of the second grid so that interfaces of the second grid coincide with interfaces of the cells of the first grid.

14. A method as claimed in claim 2, wherein the fluid flows within the medium are simulated using the first computer implemented flow simulator with a first grid discretizing the porous medium into a set of cells and fluid flows in the wellbore region are simulated using the second computer implemented simulator with a second grid discretizing the well in the wellbore region with a set of cells, the second grid being generated by constraining cells located at an edge of the second grid so that interfaces of the second grid coincide with interfaces of the cells of the first grid.

15. A method as claimed in claim 3, wherein the fluid flows within the medium are simulated using the first computer implemented flow simulator with a first grid discretizing the porous medium into a set of cells and fluid flows in the wellbore region are simulated using the second computer implemented simulator with a second grid discretizing the well in the wellbore region with a set of cells, the second grid being generated by constraining cells located at an edge of the second grid so that interfaces of the second grid coincide with interfaces of the cells of the first grid.

16. A method as claimed in claim 4, wherein the fluid flows within the medium are simulated using the first computer implemented flow simulator with a first grid discretizing the porous medium into a set of cells and fluid flows in the wellbore region are simulated using the second computer implemented simulator with a second grid discretizing the well in the wellbore region with a set of cells, the second grid being generated by constraining cells located at an edge of the second grid so that interfaces of the second grid coincide with interfaces of the cells of the first grid.

17. A method as claimed in claim 7, wherein the fluid flows within the medium are simulated using the first computer implemented flow simulator with a first grid discretizing the porous medium into a set of cells and fluid flows in the wellbore region are simulated using the second computer implemented simulator with a second grid discretizing the well in the wellbore region with a set of cells, the second grid being generated by constraining cells located at an edge of the second grid so that interfaces of the second grid coincide with interfaces of the cells of the first grid.

18. A method as claimed in claim 1, wherein multiphase flows are modelled and numerical productivity index multipliers are updated without use of the numerical productivity indices, for each phase, by calculation with the formula:

$$IP_{r,i}(T_1) = \frac{Q_{nw,i}(T_1)}{Q_{r,i}(T_1)} IP_{r,i}(T_0)$$

wherein:

$Q_{nw,i}$ is a fluid flow rate calculated with a model of the wellbore region in a section corresponding to a part of the at least one well in well cell i of the grid of the reservoir;

$Q_{r,i}$ is a fluid flow rate calculated with the model of the reservoir in an identical section, corresponding to a part of the well in well cell i of the grid of the reservoir; and $IP_{r,i}(T_1)$ and $IP_{r,i}(T_0)$ are numerical productivity indices at times $T_1$ and $T_0$ respectively, before and after updating.

19. A method as claimed in claim 2, wherein multiphase flows are modelled and numerical productivity index multipliers are updated without use of the numerical productivity indices, for each phase, by calculation with the formula:

$$IP_{r,i}(T_1) = \frac{Q_{nw,i}(T_1)}{Q_{r,i}(T_1)} IP_{r,i}(T_0)$$

wherein:

$Q_{nw,i}$ is a fluid flow rate calculated with a model of the wellbore region in a section corresponding to a part of the at least one well in well cell i of the grid of the reservoir;

$Q_{r,i}$ is a fluid flow rate calculated with the model of the reservoir in an identical section, corresponding to a part of the well in well cell i of the grid of the reservoir; and $IP_{r,i}(T_1)$ and $IP_{r,i}(T_0)$ are numerical productivity indices at times $T_1$ and $T_0$ respectively, before and after updating.

20. A method as claimed in claim 3, wherein multiphase flows are modelled and numerical productivity index multipliers are updated without use of the numerical productivity indices, for each phase, by calculation with the formula:

$$IP_{r,i}(T_1) = \frac{Q_{nw,i}(T_1)}{Q_{r,i}(T_1)} IP_{r,i}(T_0)$$

wherein:

$Q_{nw,i}$ is a fluid flow rate calculated with a model of the wellbore region in a section corresponding to a part of the at least one well in well cell i of the grid of the reservoir;

$Q_{r,i}$ is a fluid flow rate calculated with the model of the reservoir in an identical section, corresponding to a part of the well in well cell i of the grid of the reservoir; and $IP_{r,i}(T_1)$ and $IP_{r,i}(T_0)$ are numerical productivity indices at times $T_1$ and $T_o$ respectively, before and after updating.

21. A method as claimed in claim 4, wherein multiphase flows are modelled and numerical productivity index multipliers are updated without use of the numerical productivity indices, for each phase, by calculation with the formula:

$$IP_{r,i}(T_1) = \frac{Q_{nw,i}(T_1)}{Q_{r,i}(T_1)} IP_{r,i}(T_0)$$

wherein:

$Q_{nw,i}$ is a fluid flow rate calculated with a model of the wellbore region in a section corresponding to a part of the at least one well in well cell i of the grid of the reservoir;

$Q_{r,i}$ is a fluid flow rate calculated with the model of the reservoir in an identical section, corresponding to a part of the well in well cell i of the grid of the reservoir; and $IP_{r,i}(T_1)$ and $IP_{r,i}(T_0)$ are numerical productivity indices at times $T_1$ and $T_0$ respectively, before and after updating.

22. A method as claimed in claim 7, wherein multiphase flows are modelled and numerical productivity index multipliers are updated without use of the numerical productivity indices, for each phase, by calculation with the formula:

$$IP_{r,i}(T_1) = \frac{Q_{nw,i}(T_1)}{Q_{r,i}(T_1)} IP_{r,i}(T_0)$$

wherein:

$Q_{nw,i}$ is a fluid flow rate calculated with a model of the wellbore region in a section corresponding to a part of the at least one well in well cell i of the grid of the reservoir;

$Q_{r,i}$ is a fluid flow rate calculated with the model of the reservoir in an identical section, corresponding to a part of the well in well cell i of the grid of the reservoir; and $IP_{r,i}(T_1)$ and $IP_{r,i}(T_0)$ are numerical productivity indices at times $T_1$ and $T_0$ respectively, before and after updating.

23. A method as claimed in claim 13, wherein multiphase flows are modelled and numerical productivity index multipliers are updated without use of the numerical productivity indices, for each phase, by calculation with the formula:

$$IP_{r,i}(T_1) = \frac{Q_{nw,i}(T_1)}{Q_{r,i}(T_1)} IP_{r,i}(T_0)$$

wherein:

$Q_{nw,i}$ is a fluid flow rate calculated with a model of the wellbore region in a section corresponding to a part of the at least one well in well cell i of the grid of the reservoir;

$Q_{r,i}$ is a fluid flow rate calculated with the model of the reservoir in an identical section, corresponding to a part of the well in well cell i of the grid of the reservoir; and $IP_{r,i}(T_1)$ and $IP_{r,i}(T_0)$ are numerical productivity indices at times $T_1$ and $T_0$ respectively, before and after updating.

24. A method as claimed in claim 1 for exploiting an underground porous reservoir using at least one well traversing the reservoir with at least one fluid circulating between the reservoir and the at least one well, wherein data relative to geometry of the porous reservoir are acquired, from which a discretization of the reservoir into reservoir grids having a set of cells, is constructed, and a discretization of the wellbore region into a set of cells is constructed comprising:

a1) selecting a porous reservoir exploitation scenario;

b2) associating with the reservoir grid the first flow simulator for simulating the flow of fluids within the reservoir, from data the production scenario, input data relative to the fluid and to the reservoir, the numerical productivity indices allowing relating pressures to flow rates and the boundary conditions;

c3) associating with the set of cells the second flow simulator for simulating the flow of fluids in the wellbore region from at least input data relative to the fluid and the reservoir and boundary conditions;

d4) modelling the fluid flows within the reservoir and in the set of cells, by using of the first and second simulators; and e5) modifying an exploitation scenario and repeating step d4) until an optimum exploitation scenario is obtained.

25. A method as claimed in claim 24, wherein:

well damage due to drilling fluid is accounted for by modelling an invasion of the porous reservoir by the drilling fluid in d4) and e5).

26. A method as claimed in claim 24, wherein the exploitation scenario comprises injecting of a polymer solution into the well and modelling the flows to prevent water inflow.

27. A method as claimed in claim 24, comprising simulation of injection of an acid solution into the well and the flows to evaluate an impact of injection of the acid solution on exploiting the porous reservoir.

* * * * *